US005289077A

United States Patent [19]

Ugajin

[11] Patent Number: 5,289,077

[45] Date of Patent: Feb. 22, 1994

[54] MICROELECTRONIC BALLISTIC TRANSISTOR

[75] Inventor: Ryuichi Ugajin, Kanagawa, Japan

[73] Assignee: Sony Corporation, Tokyo, Japan

[21] Appl. No.: 826,459

[22] Filed: Jan. 27, 1992

[30] Foreign Application Priority Data

Jan. 28, 1991 [JP] Japan ..... 3-026944
Apr. 19, 1991 [JP] Japan ..... 3-115431
Apr. 19, 1991 [JP] Japan ..... 3-115432

[51] Int. Cl.[5] ..... H01J 19/24; H01J 1/30
[52] U.S. Cl. ..... 313/308; 313/309
[58] Field of Search ..... 313/308, 309

[56] References Cited

U.S. PATENT DOCUMENTS 4,307,507 12/1981 Gray et al. ..... 313/309 X
4,956,574 9/1990 Kane ..... 313/308 X
5,012,153 4/1991 Atkinson et al. ..... 313/309 X
5,030,895 7/1991 Gray ..... 313/309 X
5,144,191 9/1992 Jones et al. ..... 313/309 X

FOREIGN PATENT DOCUMENTS 0290026 9/1988 European Pat. Off. .
0350378 10/1990 European Pat. Off. .
0406886 9/1991 European Pat. Off. .

OTHER PUBLICATIONS

Japanese Patent Abstract Publication No. JP62173754, Jan. 1988.

*Primary Examiner*—Sandra L. O'Shea
*Attorney, Agent, or Firm*—Hill, Steadman & Simpson

[57] ABSTRACT

A vacuum microelectronic transistor which can operate at a high speed and has a high mutual conductance. The vacuum microelectronic transistor comprises an emitter for emitting electrons therefrom, a collector for receiving electrons from the emitter, and a pair of gate electrodes for controlling arrival of electrons from the emitter to the collector. The emitter and collector are disposed in an encapsulated condition on a substrate such that electrons emitted from the emitter run straightforwardly in vacuum to the collector while the gate electrodes are located adjacent and across a route of such electrons from the emitter to the collector. Also, a process of manufacturing such vacuum microelectronic transistor is disclosed.

13 Claims, 22 Drawing Sheets

MICROELECTRONIC BALLISTIC TRANSISTOR

BACKGROUND OF THE INVENTION

1. Field of the Invention

This invention relates to a vacuum microelectronic transistor wherein electrons flow in vacuum and a process of manufacturing the same.

2. Description of the Prior Art

A semiconductor device wherein electrons flow in semiconductor is limited in high speed operation due to an upper limit to mobility of electrons in the semiconductor. Therefore, attention has focussed in recent years to vacuum microelectronics wherein electrons flow in vacuum, and many investigations are being made in vacuum microelectronics.

A transistor as shown in FIG. 1 is known as a vacuum microelectronic transistor. Referring to FIG. 1, the transistor shown includes a conductive silicon (Si) substrate 1, an emitter 2 of a conical shape formed on the silicon substrate 1, and an insulating film 3 formed on the silicon substrate 1 around the emitter 2. A gate electrode (or base) 4 and a collector (or anode) 5 are formed on the insulating film 3.

The transistor of FIG. 1 performs a transistor operation suck that electrons ($e^-$) are emitted from the emitter 2 and flow through the in vacuum to the collector 5, the flow of such electrons to the collector 5 is controlled by the gate electrode 4.

In the transistor shown in FIG. 1, in order for electrons emitted from the emitter 2 to reach the collector 5, the direction of movement of the electrons must necessarily be changed a great extent as indicated by the arrow marks in FIG. 1. Therefore, electrons cannot be accelerated to a very high speed, and accordingly, high operation of the transistor cannot be achieved.

SUMMARY OF THE INVENTION

It is an object of the present invention to provide a vacuum microelectronic transistor which can operate at high speed and which has high mutual conductance.

It is another object of the present invention to provide a vacuum microelectronic transistor which can operate at high speed and reduce the area required on a substrate while assuring that a high electric current flow occurs between the emitter and the collector.

It is a further object of the present invention to provide a vacuum microelectronic transistor which can operate at high speed with high mutual conductance and which can reduce a potential difference between the emitter and the collector and can assure a high electric current flow between the emitter and the collector.

It is a still further object of the present invention to provide a process of manufacturing a vacuum microelectronic transistor which has reduced in capacitance between the electrodes and which has a superior high frequency characteristic.

It is a yet further object of the present invention to provide a process of manufacturing a vacuum microelectronic transistor in which the electrodes are spaced a very small distance from each other.

In order to attain the objects, according to an aspect of the present invention, there is provided a vacuum microelectronic transistor, which comprises a substrate, an emitter formed on the substrate for emitting electrons therefrom, a collector formed on the substrate in an opposing spaced relationship from the emitter for receiving electrons from the emitter, and a gate electrode formed on the substrate in a spaced relationship from the emitter and collector for controlling the arrival of electrons from the emitter to the collector. The emitter extends at an angle in a range of 0 to less than 90 degrees with respect to a line normal to plane of the substrate.

The vacuum microelectronic transistor is advantageous in that it operates at a high speed and allows a comparatively high electric current to flow from the emitter to the collector and it occupies a comparatively small area on the substrate because electrons emitted from the emitter flow straight over a comparatively small distance to the collector.

The vacuum microelectronic transistor is manufactured by a process which comprises the steps of forming a conductive layer on an insulating substrate, forming on the conductive layer a mask having a in shape of a emitter, a collector and a gate electrode of the transistor to be formed, etching, by using the mask, the conductive layer obliquely at an angle equal to or greater than 0 degrees but smaller than 90 degrees with respect to a normal line to a plane of the conductive layer until the insulating substrate is exposed to form a groove in the conductive layer to separate the conductive layer into an emitter, a collector and a gate electrode, and removing the mask by etching.

According to another aspect of the present invention, there is provided a vacuum microelectronic transistor, which comprises a substrate, an emitter formed on the substrate for emitting electrons therefrom, a collector formed on the substrate in an opposing spaced relationship from the emitter for receiving electrons from the emitter, and a gate electrode formed on the substrate in a spaced relationship from the emitter and collector for controlling arrival of electrons from the emitter to the collector, the emitter having an end with a plurality of three-dimensionally pointed projected portions the collector having a planar end, and the gate electrode being formed adjacent a straight line interconnecting the emitter and collector.

The vacuum microelectronic transistor is advantageous in that it operates at a high speed and has a high mutual conductance and also allows a comparatively high electric current to flow from the emitter to the collector and requires a comparatively small potential difference between the emitter and collector to cause emission of electrons from the emitter because electrons emitted from the emitter flow straight over a comparatively small distance to the collector.

The vacuum microelectronic transistor is manufactured by a process, which comprises the steps of forming an n-type GaAs layer by epitaxial growth on a semi-insulating GaAs substrate, forming on the n-type GaAs layer a mask having an opening conforming in shape to a collector of a transistor to be formed, etching, using the mask, the n-type GaAs layer and the GaAs substrate obliquely at an angle equal to or greater than 0 degrees but smaller than 90 degrees with respect to a normal line to a plane of the n-type GaAs layer until the GaAs substrate is exposed to form a groove in the n-type GaAs layer, removing the mask by etching, filling the groove with a suitable substance, forming on the n GaAs layer and the substance in the groove of the n-type GaAs layer a second mask having an opening conforming in shape to an emitter of a transistor to be formed etching. Using the second mask, the n-type GaAs layer and the GaAs substrate obliquely at an angle equal to but in the opposite direction with respect to a normal line to the plane of the n-type GaAs layer until the GaAs substrate is exposed to form a second groove in the n-type GaAs layer and the substance in the first-mentioned groove such that the first and second grooves cross each other to form an X-shape in a section, and removing the second mask by etching.

According to a further aspect of the present invention, there is provided a process of manufacturing a vacuum microelectronic transistor wherein electrons emitted from an emitter electrode flow in vacuum to a collector electrode and arrival the electrons at the collector electrode is controlled by a base electrode and the emitter, collector and base electrodes are formed in an opposing relationship to each other. The steps comprises growing a metal film at an end portion of each of electrode material portions which are to make the electrodes, and etching the electrode materials using the metal film as a mask.

With the manufacturing process, metal films are grown at end portions of electrode material portions which are to make electrodes, and then the electrode material portions are etched using the metal films as a mask. Consequently, while the distance between opposing electrodes is maintained small, the distance between adjacent electrodes can be increased at those portions of them other than the end portions. Consequently, the parasitic capacitance between adjacent electrodes can be reduced. Accordingly, the high frequency characteristic of a transistor thus produced is improved significantly.

According to a still further aspect of the present invention, there is provided a process of manufacturing a vacuum microelectronic transistor wherein electrons emitted from an emitter electrode flow in a vacuum to a collector electrode controlled by a base electrode, which comprises the steps of forming a step on a surface of an electrode material layer, forming a mask on the surface of the electrode material layer including a surface of the step which extends in parallel to the surface of the electrode material layer, and etching the electrode material layer in a plurality of direction obliquely to the surface of the electrode material layer using the mask to form grooves which cross each other to separate the electrode material layer to form emitter, collector and base electrodes.

With the manufacturing method, emitter, collector and base electrodes are separated from one another by oblique etching in a plurality of directions by a step formed on a surface of an electrode material layer. Consequently, the distance between each adjacent electrode can be a small distance which reflects the step and is not influenced by a resist pattern. As a result, a transistor can be obtained which operates at a high speed with low power consumption and low heat generation and with a low difference in potential and has a high mutual conductance.

According to a yet further aspect of the present invention, there is provided a semiconductor device, which comprises an emitter which emits electrons an anode spaced from the emitter for receiving the electrons emitted from the emitter, and a gate electrode for controlling the flow of electrons emitted from the emitter at the anode, the emitter and anode being formed as a pair of mutually opposing projected portions of a semiconductor, the gate electrode being formed adjacent a straight line interconnecting the emitter and anode.

With the semiconductor device, since the emitter and anode are formed as a pair of mutually opposing projected portions of a semiconductor and the gate electrode is formed adjacent the straight line interconnecting the emitter and anode, the semiconductor operates at a high speed and has a high mutual conductance.

The above and other objects, features and advantages of the present invention will become apparent from the following description and the appended claims, taken in conjunction with the accompanying drawings in which like parts or elements are denoted by like reference characters.

DETAILED DESCRIPTION OF THE PREFERRED EMBODIMENTS

Figure 1:
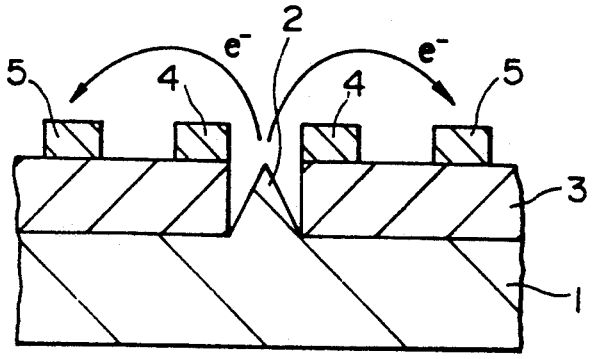
FIG. 1 (PRIOR ART)
FIG. 1 is a sectional view showing an exemplary conventional vacuum microelectronic transistor.
Figure 2:
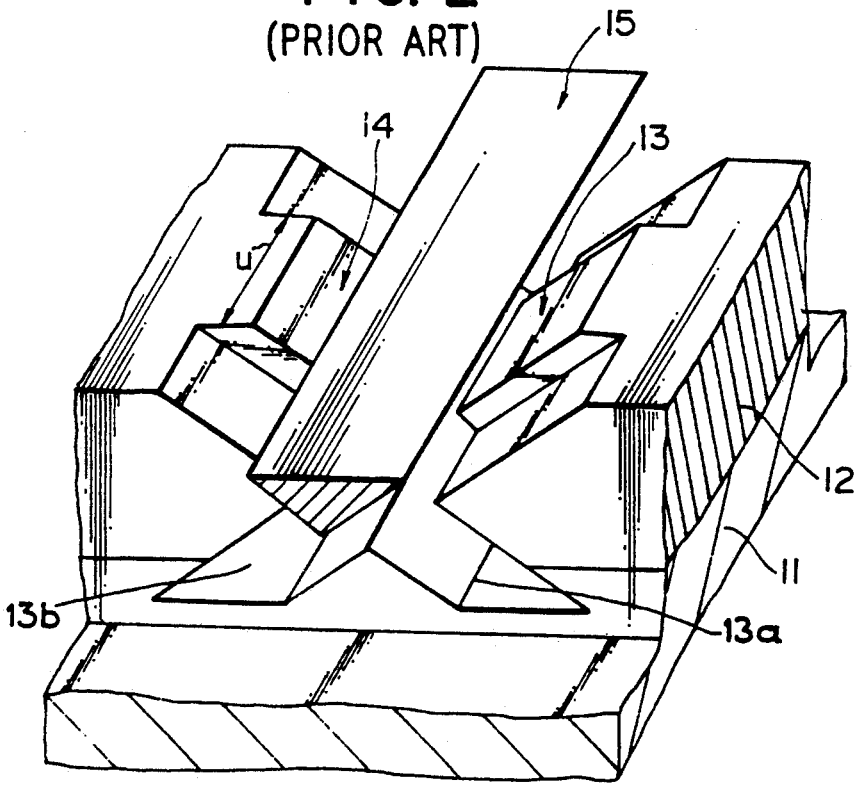
FIG. 2 (PRIOR ART)
FIG. 2 is a schematic perspective view showing a vacuum microelectronic transistor according to a first referred embodiment of the present invention.

Referring first to FIG. 2, there is shown a vacuum microelectronic transistor according to a first preferred embodiment of the present invention. The transistor shown includes a semi-insulating GaAs substrate 11 and an n-type GaAs layer 12 formed on the semi-insulating GaAs substrate 11. A pair of grooves 13*a* and 13*b* are formed in the semi-insulating GaAs substrate 11 and n-type GaAs layer 12 in an inclined relationship by predetermined angles $\theta$ and $-\theta$, respectively, with respect to a surface of the semi-insulating GaAs substrate 11 such that they cross each other so as to present an X-shape as viewed in section. Here, each of the grooves 13*a* and 13*b* has a channel-shaped section in a plane perpendicular to the depthwise direction thereof. An emitter 14 and an anode 13 are formed on a pair of opposing projecting portions of the n-type GaAs layer 12 on the opposite sides of the crossing point of the grooves 13*a* and 13*b*. Each of the emitter 14 and anode 13 has a linear end.

Figure 2A:
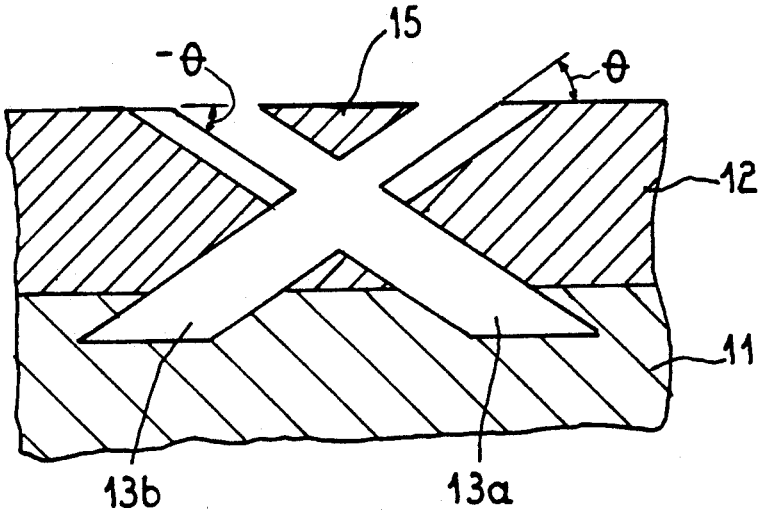
FIG. 2A is a detailed view of the invention

FIG. 2A shows an end plan view of the grooves 13*a* and 13*b* and the emitter 14 and the anode 13.

Figure 9:
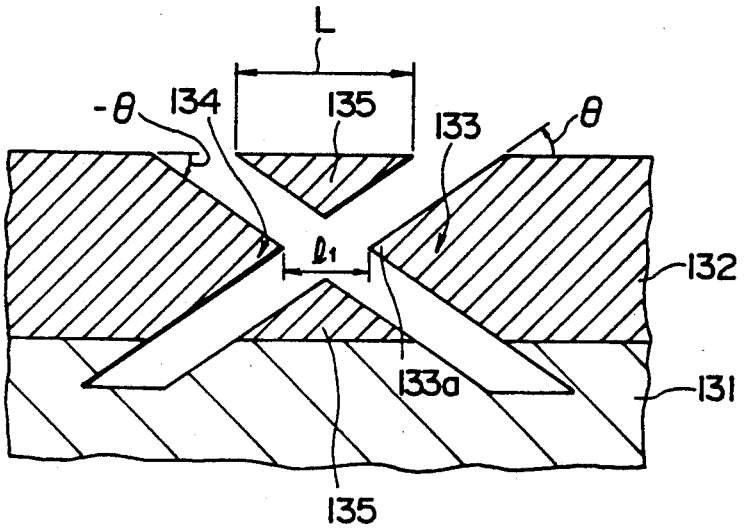
FIG. 9 is a sectional view taken along line IX—IX of FIG. 8.

The transistor further includes a gate electrode 15 made of an n-type GaAs layer and supported at an end or by opposite ends supporting element or elements not shown such that an intermediate portion thereof is clear of any other element of the transistor.

Where the nearest distance between the emitter 14 and anode 13 is represented by $I_1$ as shown in FIG. 9, the distance between a path of the electrons from the emitter 14 to the anode 13 and the gate electrodes $15_1$ is given by $(l_1/2)\tan\theta$. Here, where the distance $l_1$ is 5,000 angstroms, if the angle $\theta$ is 20 degrees, then the distance between the path of electrons and the gate electrodes 15 can be $(l_1/2)\tan\theta = 1{,}000$ angstroms.

With the vacuum microelectronic transistor, since the end of the emitter 14 falls on a straight line, extending in a horizontal direction, the current flow between the emitter 14 and the anode 13 can be increased as compared with a transistor, which has an emitter with a pointed profile. Further, since the distance between the emitter 14 and anode 13 can be reduced, the necessary potential difference between the emitter 14 and anode 13 can be reduced. Further, since the gate electrode 15 is formed above and below adjacent a path of electrons from the emitter 14 to the anode 13, the modulating efficiency of the gate electrode 15 is high, and accordingly, a high mutual conductance $g_m$ can be assured.

It is to be noted that, since the gate electrode 15 is mounted above and below adjacent the path of electrons from the emitter 14 to the anode 13 as described above, arrival of electrons from the emitter 14 to the anode 13 can be easily restricted by setting the potential of the gate electrode 15 to be negative.

Figure 3:
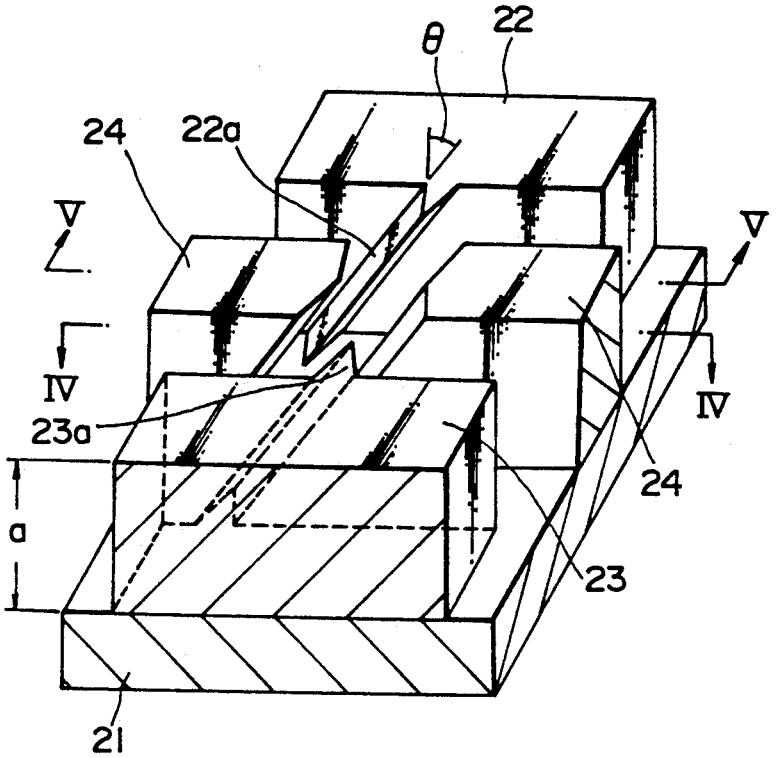
FIG. 3 is a schematic perspective view showing a vacuum microelectronic transistor according to a second preferred embodiment of the present invention.
Figure 4:
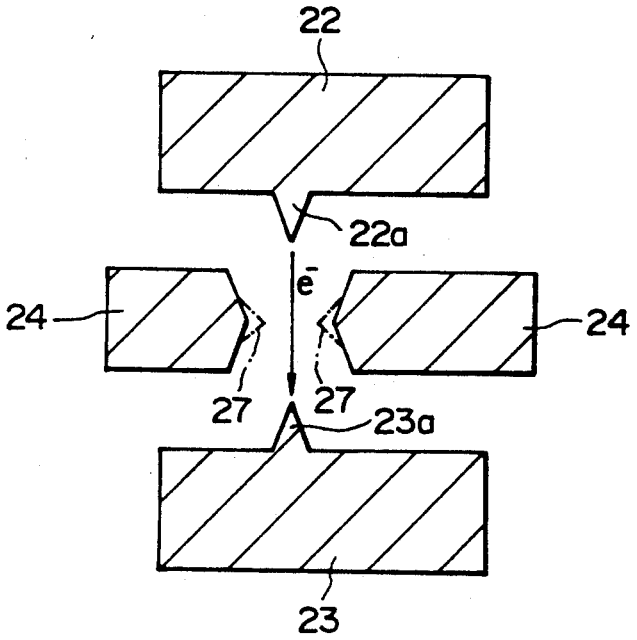
FIG. 4 is a sectional view taken along line IV—IV of FIG. 3.
Figure 5:
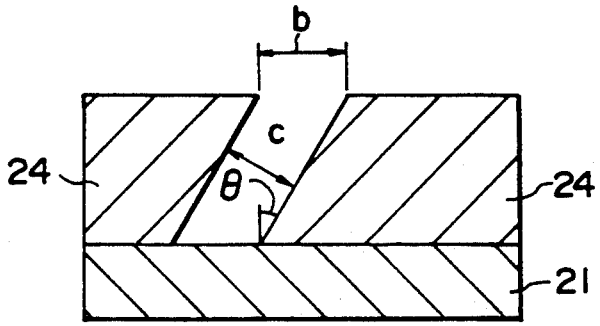
FIG. 5 is a sectional view taken along line V—V of FIG. 3.

Referring now to FIGS. 3 to 5, there is shown a vacuum microelectronic transistor according to a second preferred embodiment of the present invention. The transistor shown includes an emitter 22 and a collector 23 formed in an opposing relationship to each other on an insulating substrate 21. A pair of gate electrodes 24 are formed in an opposing relationship to each other across a path of electrons from the emitter 22 to the collector 23 on the insulating substrate 21 between the emitter 22 and the collector 23.

Since the emitter 22 and the collector 23 are formed in an opposing relationship to each other as described above, the path of electrons from the emitter 22 to the collector 23 forms a straight line between them, and accordingly, electrons can flow in a ballistic manner from the emitter 22 to the collector 23. Consequently, high efficient operation of the transistor can be achieved.

In the transistor of the present embodiment, a pair of projected portions or ribs 22*a* and 23*a* each having, for example, a prism-like shape are formed on opposing faces of the emitter 22 and collector 23, respectively. Each of the projected portions 22*a* 0 and 23*a* form a linear surface which makes an angle $\theta$ ($0 \leqq \theta \leqq 90°$) with respect to a normal line to a plane of the insulating substrate 21. In this instance, where the thickness of the emitter 22 and collector 23 is represented by a, the length L of the end of each of the projected portions 22*a* and 23*a* of the emitter 22 and collector 23 is given by $L = a/\cos\theta$ ($\geqq a$). Thus, if the angle $\theta$ is increased, then the length L of the planar end of each of the projected portions 22*a* and 23*a* is increased. For example, when the thickness a is 1 $\mu$m, if the angle $\theta$ is 60 degrees, then the length L is 2 $\mu$m.

Since the end of the emitter 22 forms a shape as described above, an emitted electric current from the emitter 22 is increased, and accordingly, an electric current flowing from the emitter 22 to the collector 23 is increased. Besides, since the planar end of the emitter 22 makes the angle $\theta$ with respect to a normal line to the plan of the substrate 21, the length of the planar end of the emitter 22 on the plane of the substrate 21 is given by $L \cdot \sin\theta$ ($<L$), and accordingly, the length is decreased to $\sin\theta$ times that of the transistor shown in FIG. 2. Consequently, the size of the transistor can be reduced and accordingly, the occupation area thereof on the surface of the substrate 21 is reduced.

It is to be noted that the opposing planar ends of the gate electrodes 24 make the same angle $\theta$ with respect to a normal line to the plane of the substrate 21 that as the linear ends of the projected portions 22*a* and 23*a* of the emitter 22 and collector 23 make (refer to FIG. 5).

The trainsistor operates in the following manner. A voltage is applied between the emitter 22 and the collector 23 such that the collector 23 has a higher potential consequently, electrons are emitted from the planar end of the projected portion 22*a* of the emitter 22 by field emission. The electrons emitted have a linear spread from the emitter 22 and flow in a ballistic manner toward the collector 23 where are collected by the collector 23 (refer to FIG. 4). Then, a transistor operation of the transistor is achieved by controlling the arrival of the electrons to the collector 23 by means of the gate electrodes 24.

The transistor described above is manufactured in the following manner.

Figure 6:
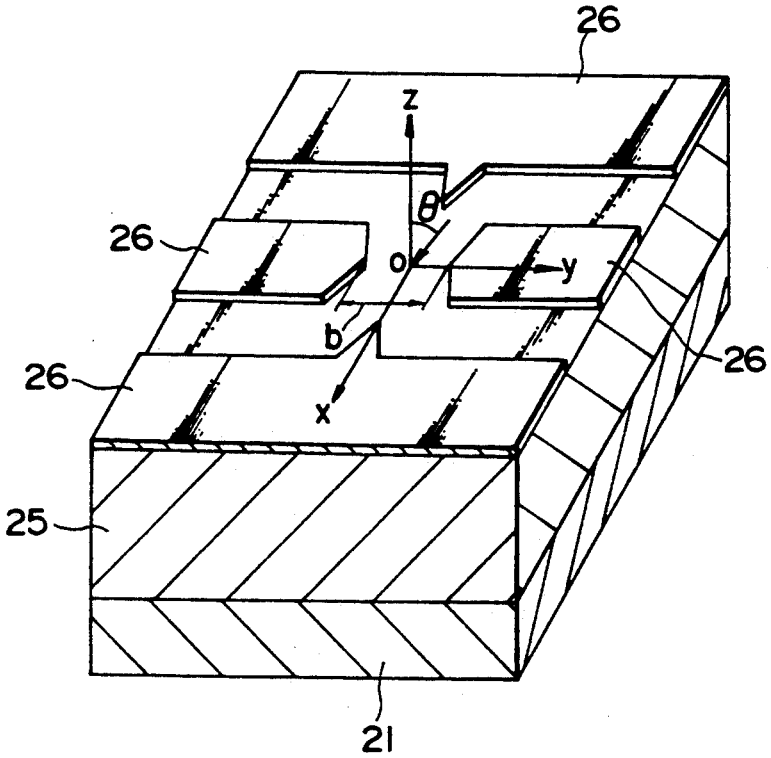
FIGS. 6 and 7 are schematic perspective views showing different steps of a process of manufacturing the vacuum microelectronic transistor shown in FIG. 3.

First, a layer 25 of a conductive substance is formed on an insulating substrate 21 as shown in FIG. 6. The layer 25 is made of a substance which has a high h conductivity and which can be etched, for example, by a reactive ion etching (RIE) method. Particularly, a metal such as, for example, tungsten (W) or molybdenum (Mo) or a semiconductor such as polycrystal silicon (Si) or GaAs can be employed for the layer 25. Meanwhile, preferably a material which will not be etched upon etching the layer 25 is used for the insulating substrate 21. It is to be noted that the insulating substrate 21 may be made in its entirety of an insulating material or may be an insulating film formed, for example, on a conductive substrate.

Then, a mask 26 such as shown conforming in shape to an emitter, a collector and gate electrodes to be formed is formed on the layer 25 by lithography and etching. The mask 26 is formed, for example, from aluminum (Al).

Subsequently, using the mask 26, the layer 25 is etched by, for example, an RIE method until the insulating substrate 21 is exposed. Such etching is performed in the direction indicated by the arow which makes an angle $\theta$, where such a coordinate system as shown in FIG. 6 is taken, with respect to the z-axis in a y-z plane. The insulating substrate 21 is kept inclined, upon etching, such that a normal line to the plane of the substrate 21 and the etching direction makes the an angle $\theta$.

Figure 7:
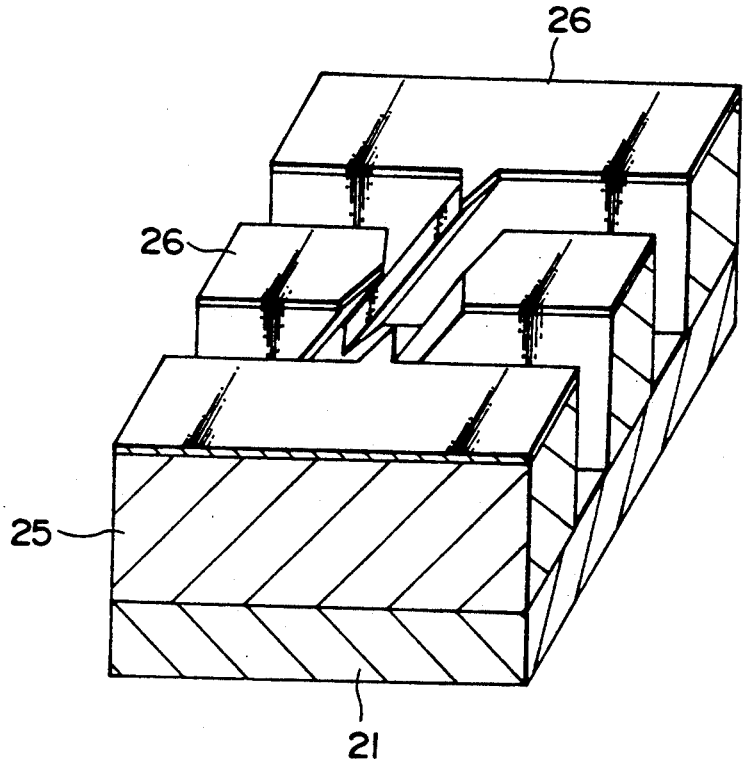

By performing etching by an RIE method in this manner, the layer 25 is etched in the same shape as the mask 26 and in the direction of the angle $\theta$ with respect to a normal line to the plane of the substrate 21 as seen from FIG. 7.

Then, the mask 26 is removed by etching, and then a groove formed in the layer 25 by the former etching is filled with a suitable substance (not shown) which can be selectively etched relative to the layer 25 and the insulating substrate 21.

Subsequently, a mask (not shown) of a predetermined shape conforming to an emitter and a collector to be formed is formed on the layer 25 and the substance in the groove formed in the layer 25, and then, using the mask, the layer 25 and the substance in the groove formed in the layer 25 are etched in a normal direction with respect to the plane of the substrate 21, for example, by an RIE method until the insulating substrate 21 is exposed. An emitter 22 and a collector 23 having such shapes as seen in FIG. 3 are formed in this manner. Then, the mask used for such etching is removed by another etching.

Such an object transistor as shown in FIGS. 3, 4 and 5 is completed in this manner.

Thus, according to the present embodiment, while the transistor maintains its advantages that it operates at a high speed and a high electric current can flow between the emitter 22 and the collector 23, since the linear surfaces of the projected portions 22*a* and 23*a* of the emitter 22 and collector 23 make the angle $\theta$ with respect to a normal line to the plane of the insulating substrate 21, the occupied area by the transistor on the surface of the insulating substrate 21 is reduced. Consequently, when a large number of transistors having the structure of the embodiment described above are formed on a same substrate, a high accumulation density can be assured.

Further, while the transistor shown in FIG. 2 requires two operations of dry etching in order to form its basic structure, the transistor of the present embodiment requires only one etching operation to form its basic structure, and accordingly, the manufacturing process of the transistor of the present embodiment is simpler.

The transistor of the present embodiment also has the following advantage. The distance between the opposing gate electrodes 24 depends upon an opening width b (refer to FIG. 6) of the mask 26, where the distance between the gate electrodes 24 is represented by c (refer to FIG. 5), the distance c is given by $c=b\cdot\cos\theta$ ($<b$). Thus, the distance c between the gate electrodes 24 can be reduced to $\cos\theta$ times the opening width b of the mask 26. If the opening width b is set to a limit dimension in patterning, for example, to 5,000 angstroms, then when the angle $\theta$ is, for example, 30 degrees, the distance between a path of electrons from the emitter 22 to the collector 23 and the gate electrode 24 can be reduced to $c/2=b\cdot\cos\theta/2=2{,}000$ angstroms. In particular, since the gate electrodes 24 are formed on the opposite sides of and adjacent of electrons from the emitter 22 to the collector 23, a high modulating efficiency by the gate electrodes 24 is assured, and accordingly, a high mutual conductance $g_m$ can be assured.

Further, since the gate electrodes 24 can be formed on the opposite sides of and adjacent the path of electrons from the emitter 22 to the collector 23 as described above, arrival of electro gap from the emitter 22 to the collector 23 can be easily controlled by making the potential of gate electrode 24 negative with respect to the emitter 22.

In addition, the mutual conductance gm can be further increased by the following means.

In particular, an insulating substrate 21 on which an emitter 22, a collector 23 and a pair of gate electrodes 24 are to be formed is placed into a predetermined vacuum chamber, not shown, and then, predetermined raw material gas (for example, metal compound gas) is introduced into the vacuum chamber. In an atmosphere of such raw material gas, molecules of the raw material are attracted to surfaces of the emitter 22, collector 23 and gate electrodes 24. Then, in this condition, a sufficiently high voltage is applied between the gate electrodes 24 to cause discharge them. Consequently, electrons are emitted from an end of a lower potential one of the gate electrodes 24, and the thus emitted electrons are collected on the other electrode 24 having a higher potential. In this instance, the electrons tend to concentrate upon or around an end of the gate electrode 24 at which the electric field has the highest intensity.

When the electrons collide with raw material molecules attracted to the surface of the end of the gate electrode 24 in this manner, disintegration of the attracted raw material molecules is caused by the electrodes. Consequently, a layer 27 of a substance produced by such disintegration selectively grows at the end portion of the gate electrode 24 as indicated by a chain line in FIG. 4. The layer 27 tends to accumulate so it is thicker where a greater number of electrons collide. The number of such colliding electrons is highest at a terminal portion of the gate electrode 24 and decreases far away from the terminal portion, and consequently, the layer 27 presents a shape sharper than the end of the gate electrode 24.

Due to the fact that the layer 27 has a sharper shape than the end of the particular one of the gate electrodes 24 grows at the end portion of the gate electrode 24 and that the distance between the gate electrodes 24 is decreased as a result of such growth of the layer 27, the voltage required to be applied between the gate electrodes 24 in order to cause emission of electrons is decreased as compared with that before the layer 27 is formed. Thus, if the voltage applied between the gate electrodes 24 is made a little lower than an initial voltage to cause discharging, the growth of the layer 27 further progresses so that the end of the layer 27 forms a sharper profile. As a result, the voltage required to be applied between the gate electrodes 24 in order to cause emission of electrons is further decreased.

After the layer 27 of a predetermined thickness and shape is grown at the end portion of the particular one of the gate electrodes 24 in this manner, another layer 27 having a sharp end is grown also at the end portion of the other electrode 24 by a similar method.

By such means as described above, the distance between the ends of the gate electrodes 24 and the path of electrons from the emitter 22 to the collector 23 can be further reduced, and consequently, the mutual conductance $g_m$ of the transistor can be further decreased.

Further, by applying a voltage between the emitter 22 and the collector 23 to cause discharge a further layer 27 having a sharper shape than an end of the emitter 22 can be grown at an end portion of the emitter 22 in a similar manner as described above. Then, due to the fact that the layer 27 is grown at the end portion of the emitter 22 and that the distance between the emitter 22 and collector 23 is decreased as a result of such growth of the layer 27, emission of electrons from the emitter 22 can be facilitated. Particularly, if a cesium (Cs) layer or the like having a property of facilitating emission of electrons is grown as the layer 27, then emission of electrons can take place very readily, and consequently, the voltage to be applied between the emitter 22 and collector 23 in order to cause emission of electrons can be made very Referring now to FIGS. 8 to 10, there is shown a vacuum microelectronic transistor according to a third preferred embodiment of the present invention. The transistor shown includes an n-type GaAs layer 132 formed on a semi-insulating GaAs substrate 131. An emitter 133 and a collector 134 are formed by a pair of opposing projected portions of the n-type GaAs layer 132. In this instance, upper and lower side inclined faces of the emitter 133 are inclined by angles $\theta$ and $-\theta$, respectively, with respect to a plane of the substrate 131 while upper and lower side inclined faces of the collector 134 are inclined by the angles $\theta$ and $-\theta$, respectively, with respect to the plane of the substrate 131 (refer to FIG. 9).

Since the emitter 133 and the collector 134 are formed in an opposing relationship to each other as described above, a path along which electrons emitted from the emitter 133 flow to the collector 134 extends linearly. Accordingly, in order for electrons emitted from the emitter to reach the collector, the direction of movement of the electrons need not change to a great extent as in a conventional transistor. Consequently, electrons can flow a ballistic manner from the emitter 133 to the collector 134, and accordingly, a high speed operation of the transistor can be achieved.

Figure 8:
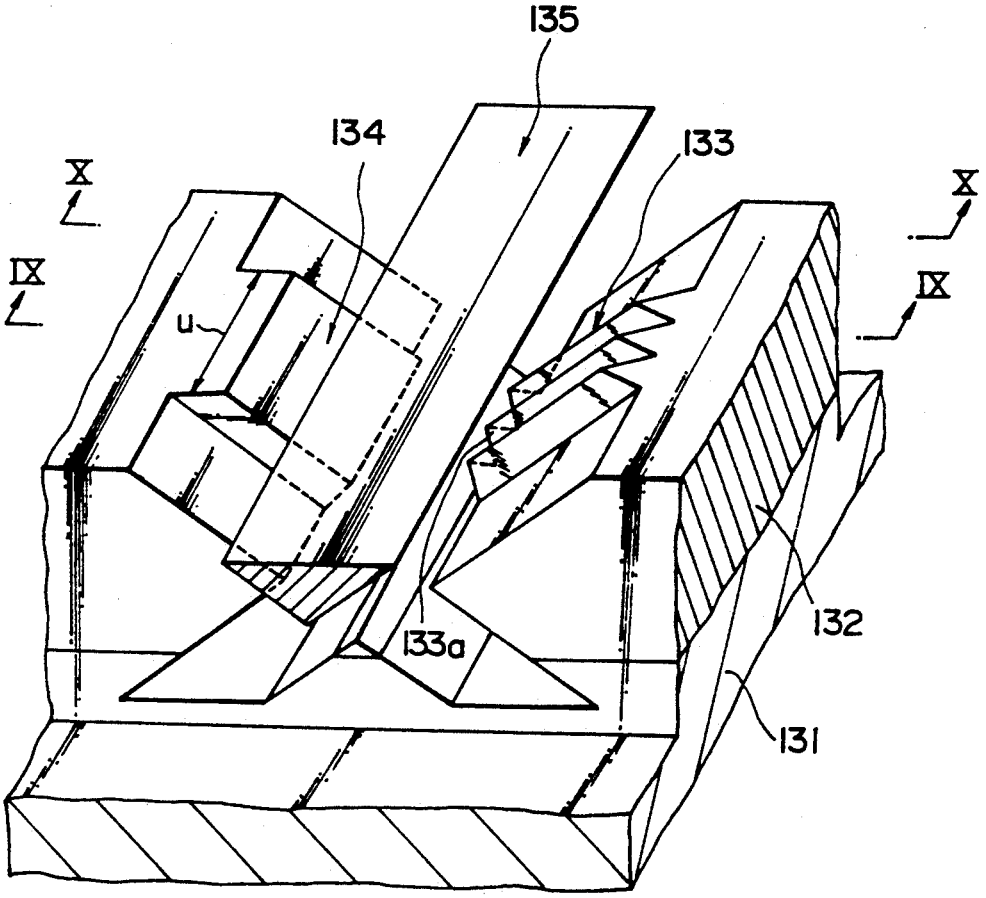
FIG. 8 is a schematic perspective view showing a vacuum microelectronic transistor according to a third preferred embodiment of the present invention.

In the vacuum microelectronic transistor of the present embodiment, a plurality of projected portions **133*a* are formed at an end of the emitter 133 such that they are sharply pointed three-dimensionally toward the collector 134. In FIG. 8, the emitter 133 shown has up to three such projected portions 133*a*. Meanwhile, an end of the collector 134 presents a linear line expending perpendicularly to a straight line interconnecting the emitter 133 and collector 134**.

A pair of gate electrodes 135 are formed above and below adjacent the straight line interconnecting the emitter 133 and collector 134. The gate electrodes 135 are each made of, for example, an n-type GaAs layer and supported, for example, at the opposite ends thereof by supporting portions not shown such that an intermediate portion thereof is clear of any element of the transistor.

Now, where the distance between the emitter 133 and collector 134 is represented by $l_1$ the distance between the path of the electrons from the emitter 133 to the collector 134 and the gate electrodes 135 is given by $l_1/2)\tan\theta$. Here, if the distance is set a limit dimension of patterning, for example, to 5,000 angstroms, then if the angle $\theta$ is 20 degrees, the distance between the route of electrons from the emitter 133 to the collector 134 and the gate electrodes 135 can be $(l_1/2)\tan\theta = 1{,}000$ angstroms.

Further, since the gate electrodes 135 are formed above and below adjacent the path of the electrons from the emitter 133 to the collector 134 as described above, arrival of electrons from the emitter 133 to the collector 134 can be controlled readily by making the potential at the gate electrodes 135 negative with respect to the emitter 133.

Figure 10:
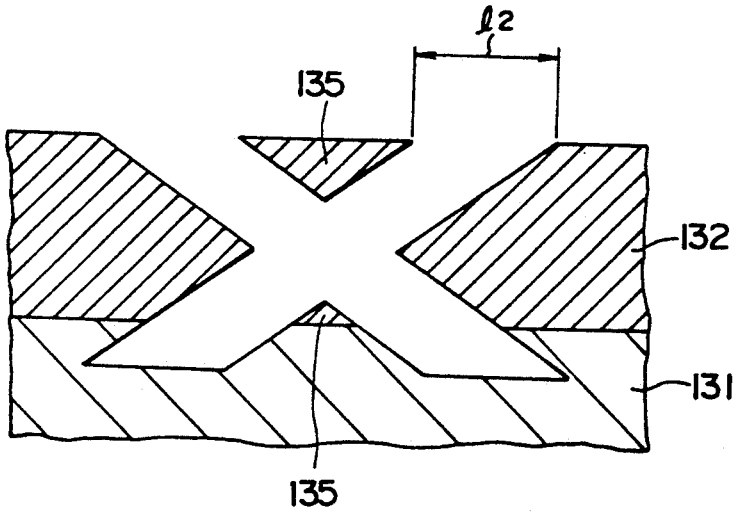
FIG. 10 is a sectional view taken along line X—X of FIG. 8.

Further, a dimension u (refer to FIG. 8) of the emitter 133 and collector 134 in a direction perpendicular to the sections shown in FIGS. 9 and 10 can be set to an arbitrary dimension. Accordingly, by making the dimension u sufficiently large, a sufficiently high electric current flow between the emitter 33 and collector 34 can be assured.

It is to be noted that an area of a width $l_2$ in FIG. 10 is provided to assure electric isolation among the emitter 133, collector 134 and gate electrodes 135.

A process of manufacturing the transistor described above will be described subsequently with reference to FIGS. 11A to 11E.

Figure 11A:
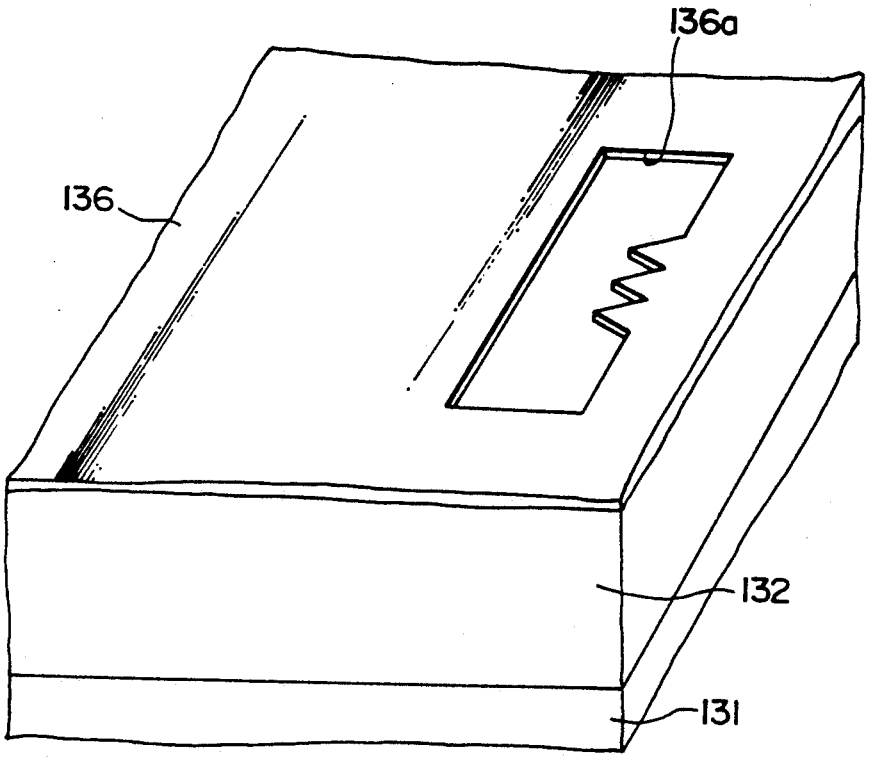
FIGS. 11A to 11E are schematic perspective views showing different steps of a process of manufacturing the vacuum microelectronic transistor shown in FIG. 8.
Figure 11B:
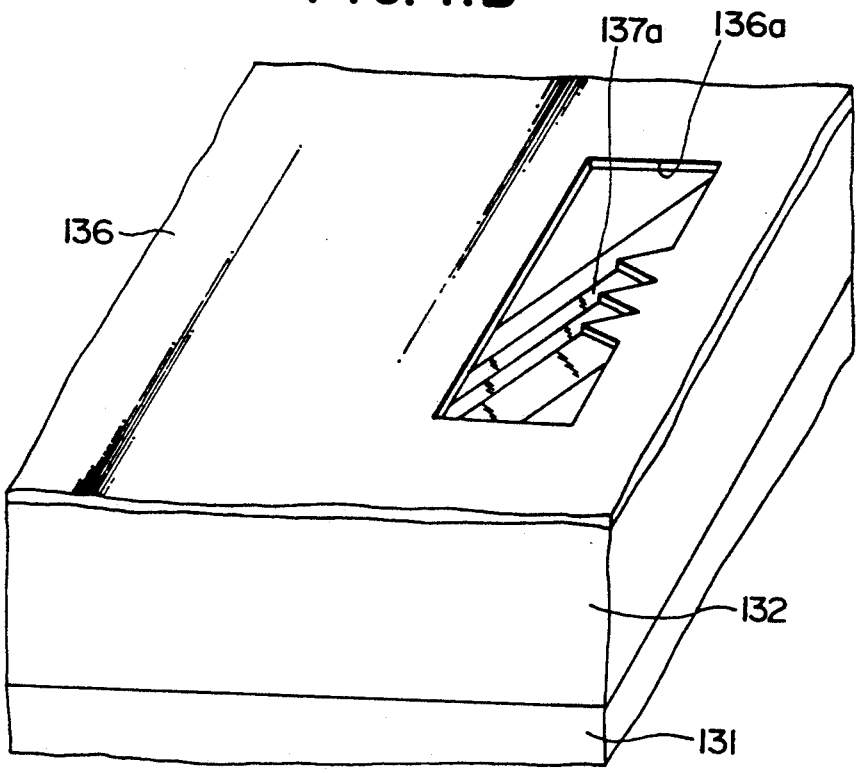

First, an n-type GaAs layer 132 is epitaxially grown on a semi-insulating GaAs substrate 131 as shown in FIG. 11A, for example, by an organometal chemical vapor phase epitaxy (MOCVD) method. The thickness of the n-type GaAs layer 132 here is $(L+l_1)\tan\theta$, where L is a width of the gate electrodes 135 (refer to FIG. 9). Subsequently, a mask 136 having an opening **136*a* of a predetermined shape conforming to a shape of a collector to be formed is formed on the n-type GaAs layer 132. The mask 136** is, for example, formed from aluminum (Al).

Then, using the mask 136, the n-type GaAs layer 132 and the semi-insulating GaAs substrate 131 are etched to a predetermined depth by a dry etching method such as, for example, a reactive ion etching (RIE) method. Upon such etching, the semi-insulating GaAs substrate 131 is kept inclined by an angle of $(\pi/2-\theta)$ with respect to an etching direction. Consequently, a groove 137*a* which is inclined by the angle of $\theta$ with respect to a plane of the substrate 131 is formed as seen from FIG. 11B.

Figure 11C:
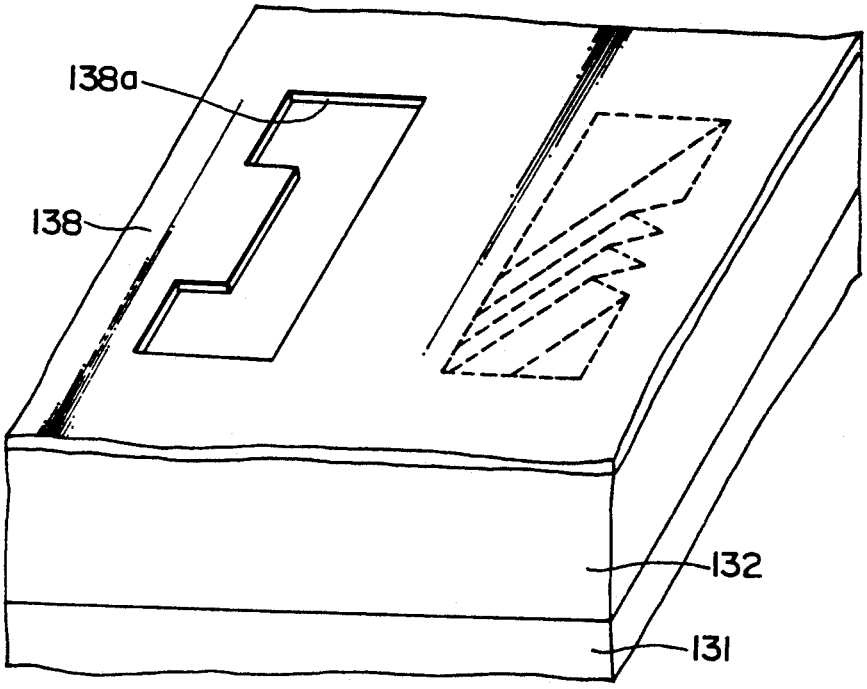

Subsequently, the mask 136 is removed by etching, and the groove 137*a* is filled with a substance (not shown) such as, for example, $SiO_2$. Then, a mask 138 having an opening 138*a* of a predetermined shape conforming to a shape of an emitter to be formed is formed as shown in FIG. 11C. Also the mask 138 is formed, for example, from aluminum.

Figure 11D:
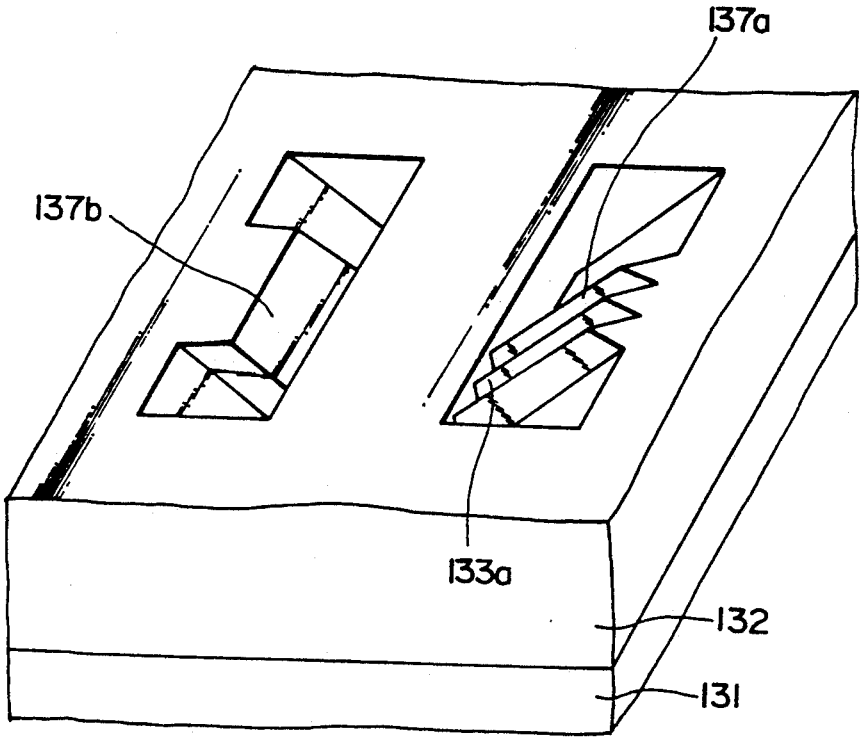

Then, using the mask 138, the n-t-ype GaAs layer 132 and the semi-insulating GaAs substrate 131 are etched to a predetermined depth in a similar manner as described above by, for example, an RIE method. In this instance, the semi-insulating GaAs substrate 131 is kept inclined by the agle of $-(\pi/2-\theta)$ with respect to an etching direction. Then, the mask 138 is removed by etching. Consequently, a groove 137*b* which is inclined by the angle of $=\theta$ with respect to the plane of the substrate 131 is formed in a crossing relationship to the groove 137*a* so as to obtain an X-shaped configuration as shown in FIG. 11D.

Figure 11E:
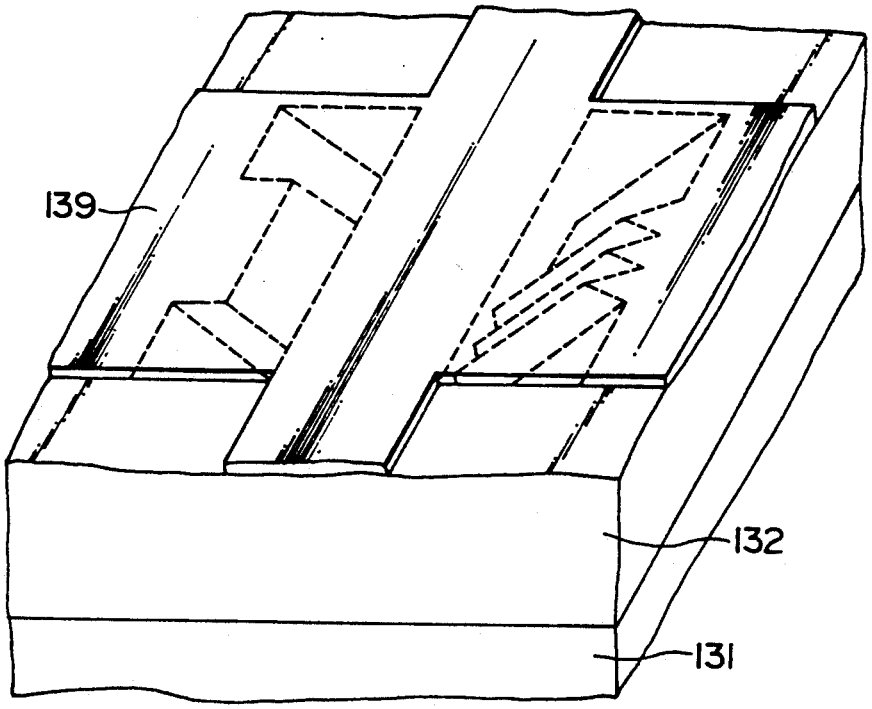

Subsequently, the groove 137*b* formed in this manner is filled with a substance (not shown) such as, for example, $SiO_2$, and then a mask 139 of a shape conforming to shapes of an emitter, a collector and gate electrodes to be formed is formed on the n-type GaAs layer 132 and the substance layers formed in the grooves 137*a* and 137*b* as seen in FIG. 11E.

Then, using the mask 139, the n-type GaAs layer 132 and the semi-insulating GaAs substrate 131 are etched to a predetermined depth in a direction perpendicular to a surface of the substrate 131 by, for example, an RIU method, and then the mask 139 is removed by etching. Then, the substance in the grooves 137*a* and 137*b* is removed by etching. Consequently, the transistor as shown in FIGS. 8, 9 and 10 is completed.

Thus, with the vacuum microelectronic transistor of the present invention, a high operation is possible and the mutual conductance is high and the electric current flowing between the emitter 134 and collector 135 can be increased. Also, the intensity of an electric field around the plurality of three-dimensionally sharply pointed projected portions 133*a* formed at the end of the emitter 133 is made to be high so that emission of electrons from the emitter 133 will readily take place, and consequently, the potential difference required between the emitter 133 and collector 134 is decreased.

It is to be noted that, while GaAs is employed as the material for the formation of the transistor of the embodiment described above, it is possible to employ not only a semiconductor such as, for example, Si other than GaAs but also a metal such as, for example, tungsten (W) or molybdenum (Mo).

Subsequently, a process of manufacturing a vacuum microelectronic transistor wherein tungsten is employed as the material for the electrodes and an emitter electrode, a collector electrode and a base electrode which are spaced small distances in a vacuum will be described as a fourth embodiment of the present invention.

Figure 12:
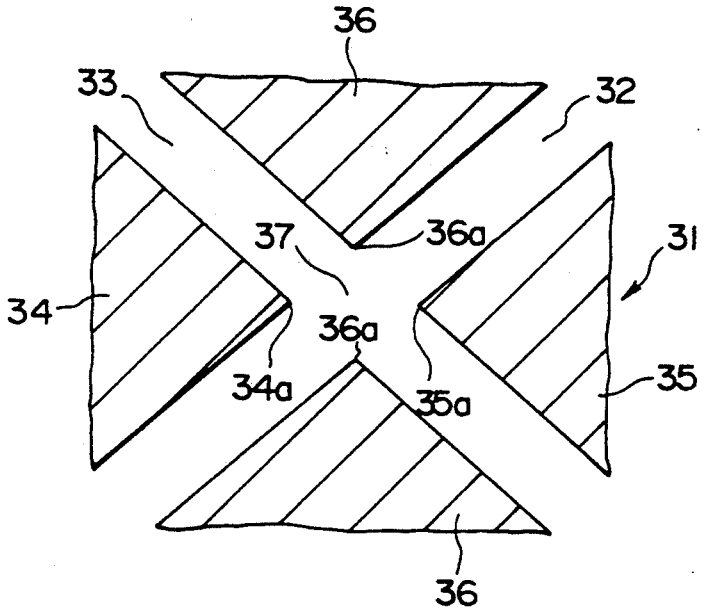
FIG. 12 is a schematic sectional view showing electrodes after formation of an X-shaped groove in a process of manufacturing a vacuum microelectronic transistor according to a fourth preferred embodiment of the present invention.
Figure 13:
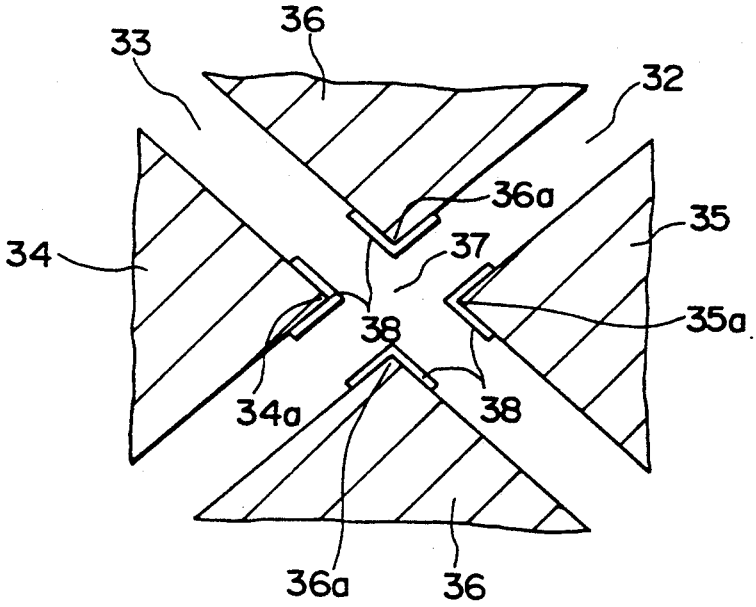
FIG. 13 is a similar view but showing the electrodes of FIG. 12 after formation of a metal film thereon.

First, a tungsten layer 31 is formed, for example, on an insulating substrate not shown, and it is then etched in two oblique directions with respect to a main surface of the substrate to form a pair of grooves 32 and 33 in the tungsten layer 31. The grooves 32 and 33 cross each other to form an X-shape in the tungsten layer 31. The tungsten layer 31 is thus separated by the grooves 32 and 33 into an emitter electrode 34, a collector electrode 35 and a pair of base electrodes 36. At the crossing location 37 of the grooves 32 and 33, an end portion 34*a* of the emitter electrode 34 and an end portion 35*a* of the collector electrode 35 are opposed to each other while a pair of end portions 36*a* of the base electrodes 36 are opposed to each other. The distance between the end portion 34*a* of the emitter electrode 34 and the end portion 35*a* of the collector electrode 35 is several hundreds angstroms or so, and the end portions 34*a* and 35*b* are each shaped into a pointed end like an edge of a cutter see FIGS. 12 and 13.

Subsequently, a cesium film 38 which acts as a mask is formed at the end portion 34*a* of the emitter electrode 34, the portion 35*a* of the collector electrode 35 and at the end portions 36*a* of the base electrodes 36. In this instance, if the electrodes 34, 35 and 36 are placed in position into an apparatus of a cesium compound gas atmosphere, for example, together with the substrate on which they are formed and then an electric current is supplied between the electrodes, then cesium films 38 are obtained in a self-registering condition at the end portions 34*a*, 35*a* and 36*a* of the electrodes 34, 35 and 36.

More particularly, as the substrate on which the electrodes 34, 35 and 36 are formed is placed in position into such atmosphere as described above while it is cooled, cesium compound gas molecules are attracted to the surfaces of the electrodes 34, 35 and 36. Further, as an electric current is supplied between the electrodes 34, 35 and 36, the molecules are disintegrated by energy supplied thereto by the electric current so that the cesium compound grows at the end portions 34*a*, 35*a* and 36*a* of the electrodes 34, 35 and 36. In case it is difficult to form metal films simultaneously on all of the electrodes, a film may be formed on one after another of the electrodes. Although a voltage can be applied, individually to electrodes from the terminals after the formation of grooves, when the device is included in an integrated circuit, an electron beam may be irradiated upon an end portion of each electrode. Also irradiation of an electron beam can achieve disintegration of metal compound gas molecules and growth of a film by kinetic energy of electrons.

While the metal film formed is the cesium film 38 in the present embodiment, it may alternatively be another metal film such as, for example, an aluminum film. Here, if a metal film having a low work function is selected as a metal film to be formed at the end portion 34*a* of the emitter electrode 34, then the voltage for emission of electrons from the emitter electrode 34 can be decreased. It is to be noted that, while in the present embodiment a cesium film is formed on all of the electrodes, different materials may be employed for the different electrodes, and besides, each film need not be a metal film of a single material but may be formed from a lamination of metal films of different metals.

Figure 14:
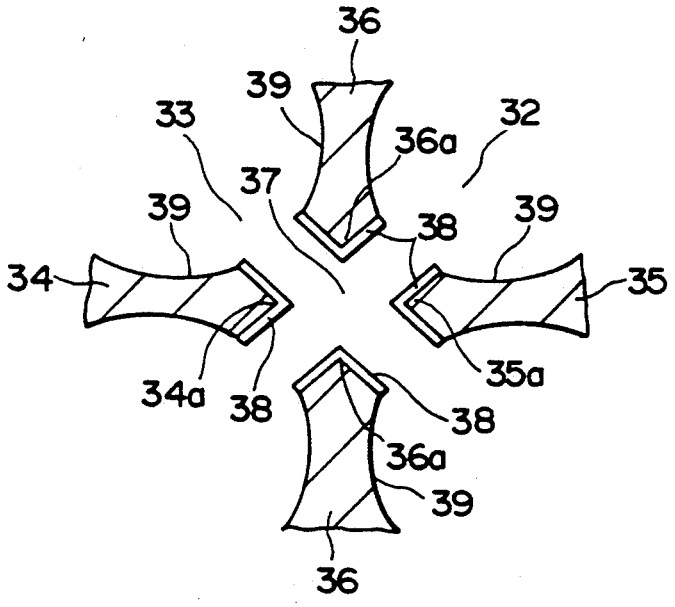
FIG. 14 is a similar view but showing the electrodes of FIG. 13 after etching.

After formation of such cesium films 38, isotropic dry etching is performed using the cesium films 38 as a mask. By such etching, tile cesium films 38 are not etched, but only tungsten which is the electrode material is selectively removed. As a result of such etching, the grooves 32 and 33 are expanded at all portion of the electrodes 34, 35 and 36 other than the cesium films 38 so that a pair of recessed portions of a moderate curvature are formed on the opposite sides of a base end portion of each of the electrodes 34, 35 and 36. Due to formation of such recessed portions 39 as shown in FIG. 14, the distances between the base electrodes 36 and emitter electrode 34 and between the base electrodes 36 and collector electrode 35 are increased except at the end portions. Consequently, the capacity between each of the adjacent electrodes is decreased, and the high frequency characteristic of the transistor is improved remarkably.

It is to be noted that, while tungsten is employed as the electrode material, the material is not limited to tungsten and other material may be employed. In such instance, a material having selectivity upon etching from an electrode material should be coated as a metal film.

Subsequently, a transistor to be manufactured by a manufacturing process according to a fifth embodiment of the present invention will be described with the manufacturing process.

Figure 15:
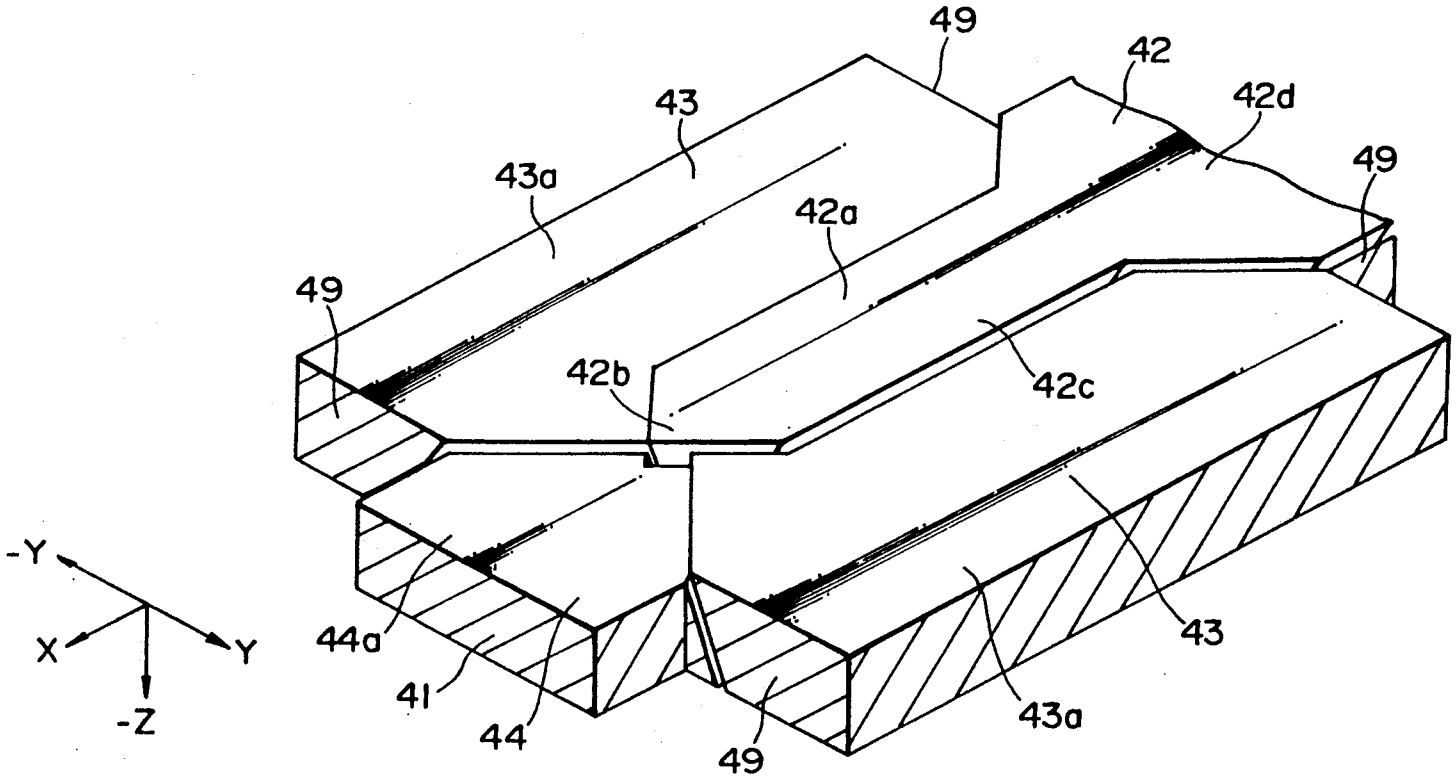
FIG. 15 is a schematic perspective view showing a vacuum microelectronic transistor according to a fifth preferred embodiment of the present invention.
Figure 16:
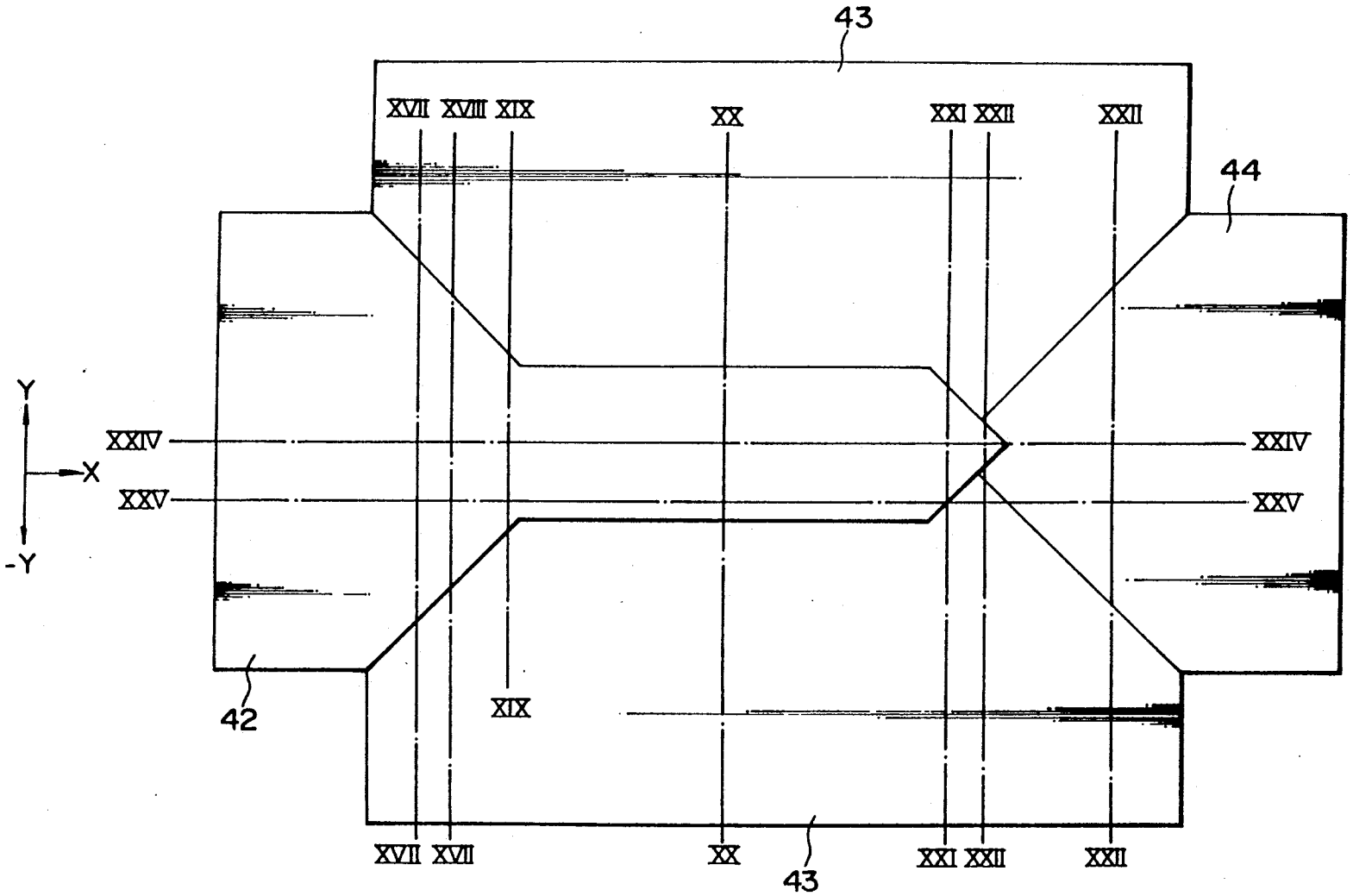
FIG. 16 is a schematic plan view of the vacuum microelectronic transistor of FIG. 15.

Referring to FIG. 15, a transistor according to the present embodiment is formed by working a tungsten layer 41 formed on a substrate (not shown) made of silicon oxide. Separated portions of the tungsten layers 41 formed by oblique etching act as an emitter electrode 42, a pair of base electrodes 43 and a collector electrode 44.

The emitter electrode 42 is provided to emit electrons to the collector electrode 44 and has a surface portion 42*a* including an end portion 42*b* in the form of a pointed end, a rectangular portion 42*c* having a substantially fixed width and a base end portion 42*d* expanded toward the other end portion. The surface portion 42*a* is provided at a higher location than the surface portions 43*a* and 44*a* of the other base electrodes 43 and collector electrode 44 such that steps may be provided between the surface portion 42*a* of the emitter electrode 42 and the base electrodes 43 and between the surface portion 42*a* and the collector electrode 44. The emitter electrode 42 is shaped by oblique etching from the step around the surface portion 42*a* thereof such that no X-direction component is involved in the XYZ coordinate system. Such etching progresses inwardly in two different directions toward the emitter electrode 42, and one of such directions has a component in the Y direction while the other direction has another component in the −Y direction. Further, the emitter electrode 42 is shape o taper toward a bottom portion (in the −Z direction) as hereinafter described.

The collector electrode 44 is provided to receive electrons which have been emitted from the emitter electrode 42 and travel in a vacuum. The collector electrode 44 partially extends from the surface portion 44*a* thereof in the form of a home plate toward the bottom of the emitter electrode 42. The surface portion 44*a* of the collector electrode 44 is formed with a height lower than the surface portion 42*a* of the emitter electrode 42 and besides lower than the surface portions 43*a* of the base electrodes 43. Due to such difference in height, the collector electrode 44 has a step around the surface portion 44*a* thereof and is separated at the stepped portion thereof from the other electrodes by such oblique etching as described above. While the emitter electrode 42 has a tapered profile toward the bottom portion (in the −Z direction) as described above, the collector electrode 44 has a spreading profile toward the bottom portion (in the −Z direction).

The base electrodes 43 are provided to control arrival of electrons emitted from the emitter electrode 42 at the collector electrodes 44. The surface portion 43*a* of each of the base electrodes 43 is such that it has a substantially linear end portion in the X direction along the rectangular portion 42*c* of the emitter electrode 42 and further has another end portion extending obliquely to both of the X and Y axes along the base end portion 42*d* of the emitter electrode 42 and a further end portion extending substantially in a triangular shape along the end portion 42*b* of the emitter electrode 42 and the surface portion 44*a* of the collector electrode 44. The surface portions 43*a* of the base electrodes 43 are located lower than the surface portion 42*a* of the emitter electrode 42 but higher than the surface portion 44*a* of the collector electrode 44. Accordingly, the base electrodes 43 have steps with respect to the emitter electrode 42 and the collector electrode 44, but since the steps are small, the electrodes 42, 43 and 44 can be separated by very small distances from one another.

Four grooves 49 are formed adjacent the electrodes 42, 43 and 44 by cutting the tungsten layer 41 in the Z direction. The grooves 49 are provided to separate the electrodes from one another and continue to a pair of grooves 45 and 46 formed by oblique etching described hereinbelow.

Figure 24:
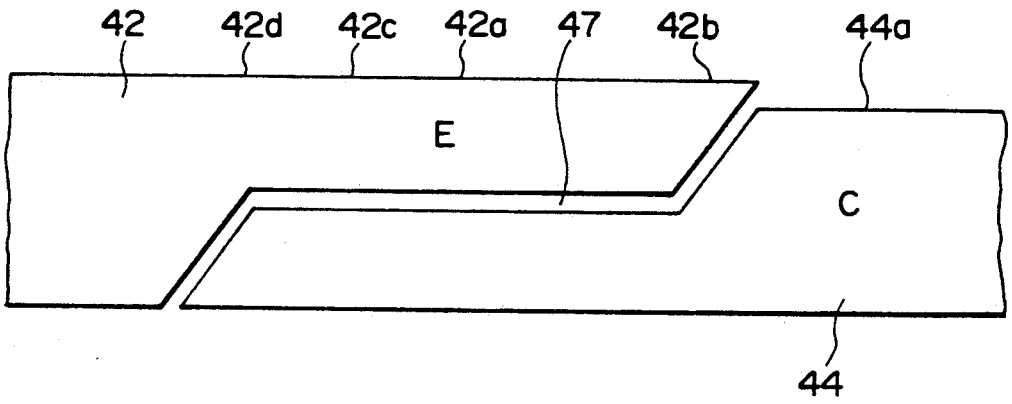
FIG. 24 is a sectional view taken along line XXIV—XXIV of FIG. 16.
Figure 25:
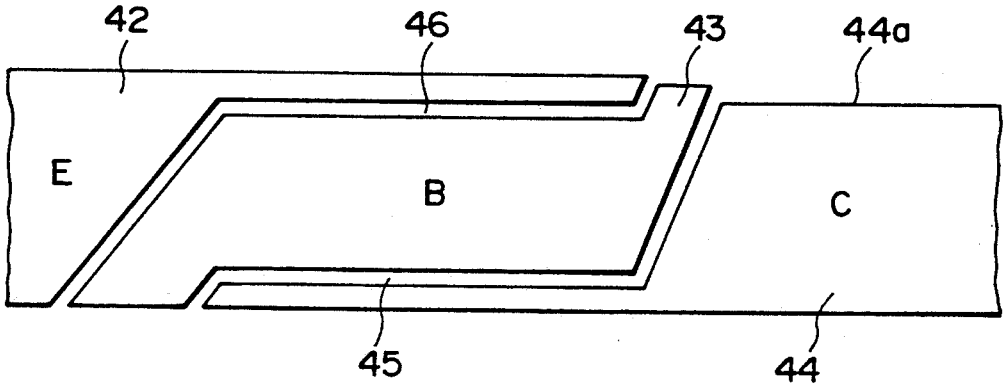
FIG. 25 is a sectional view taken along line XXV—XXV of FIG. 16.

Three dimensional shapes of the grooves formed by oblique etching will be described in detail with reference FIGS. 16 to 25. FIGS. 17 to 23 show sections taken in planes perpendicular to the X direction while FIGS. 24 and 25 show sections taken in planes perpendicular to the Y direction. In the transistor of the present embodiment, a pair of grooves 45 and 46 are formed adjacent the steps by two operations of oblique anisotropic etching, and the emitter electrode 42, collector, electrode 44 and base electrodes 43 are separated by very small distances from one another by the grooves 45 and 46. The groove 45 is formed as an oblique groove having a component in the −Y direction which increases toward the depthwise direction (−Z direction) of the substrate 41 in the XYZ coordinate system while the other groove 46 is formed as another oblique groove having a component in the Y direction which increases toward the depthwise direction of the substrate 41.

Figure 17:
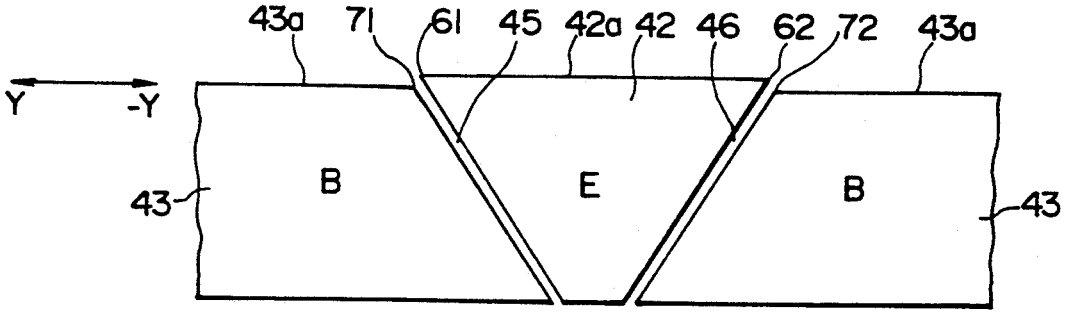
FIG. 17 is a sectional view taken along line XVII—XVII of FIG. 16.

Referring to FIG. 17, the section includes the base end portion 42*d* of the emitter electrode 42. At the bottom portion of the emitter-electrode 42, the groove 45 extends toward the right downwardly and does not cross the other groove 46 which extends toward the right and upwardly. The emitter electrode 42 has a trapezoidal sectional shape at a portion thereof between the grooves 45 and 46, and the base electrodes 43 are opposed to and on the opposite sides of the emitter electrode 42 with the grooves 45 and 46 left between them. In the section, groove 45 is defined by the step between an end 61 of the surface portion 42*a* of the emitter electrode 42 and an end 71 of the surface portion 43*a* of one of the base electrodes 43 while the groove 46 is formed by the step between the other end 62 of the surface portion 42*a* of the emitter electrode 42 and an end 72 of the surface portion 43*a* of the other base electrode 43.

Figure 18:
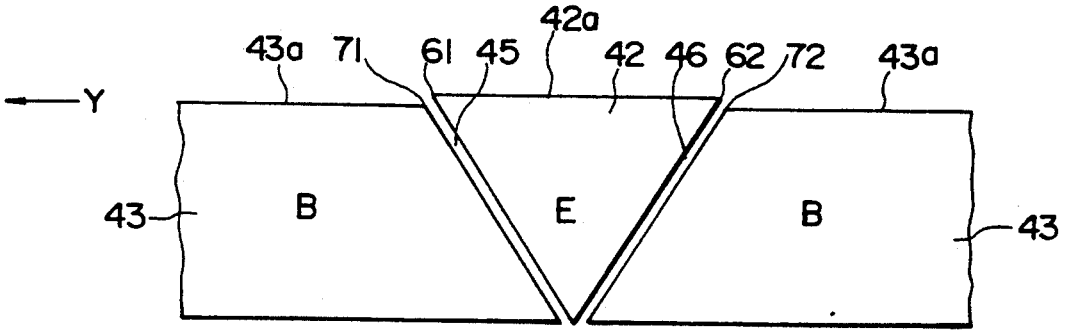
FIG. 18 is a sectional view taken along line XVIII—XVIII of FIG. 16.

Referring now to FIG. 18, this section includes the base end portion 42*d* of the emitter electrode 42 but is taken at a position displaced a little toward the end portion 42*b* of the emitter electrode 42 from the section of FIG. 17. Further, in the section of FIG. 18, since the distance between the ends 61 and 62 of the surface portion 42*a* of the emitter 42 are decreased, the grooves 45 and 46 are displaced toward the center as compared with those in the section of FIG. 17. As a result, in the section of FIG. 18, the bottom portions of the grooves 45 and 46 communicate with each other while the emitter electrode 42 has a V-shaped section between the grooves 45 and 46. Also in the section of FIG. 18, the groove 45 is formed from the step between the ends 61 and 71 while the other groove 46 is formed from the step between the ends 62 and 72 described above.

Figure 19:
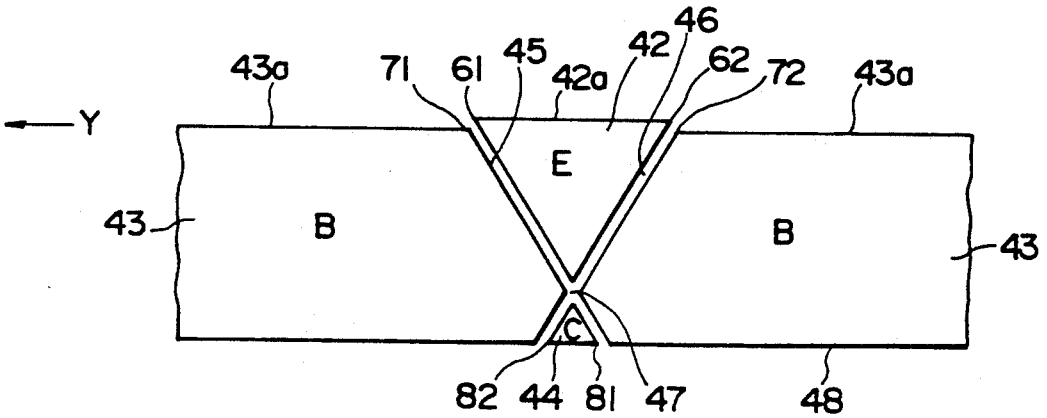
FIG. 19 is a sectional view taken along line XIX—XIX of FIG. 16.

Referring now to FIG. 19, this section indicates that the distance between the ends 61 and 62 of the surface portion 42*a* of the emitter electrode 42 is reduced further than that in the section of FIG. 18 and the grooves 45 and 46 cross each other at a location above the bottom 48 of the tungsten layer 41 such that form an X-shaped pattern. At the crossing point 47 of the grooves 45 and 46, the base electrodes 43 are opposed to each other and the collector electrode 44 is opposed to the emitter electrode 42 with a very small distance left therebetween. As the positions of the ends 61 and 62 approach each other, the crossing point 47 is spaced away from the bottom 48 of the tungsten layer 41 from the base end side toward the other end side of the emitter electrode 42. Further, as the crossing point 47 is spaced away from the bottom 48 of the tungsten layer 41, also the distance between ends 81 and 82 of the bottom portion of the collector electrode 44 is increased.

Figure 20:
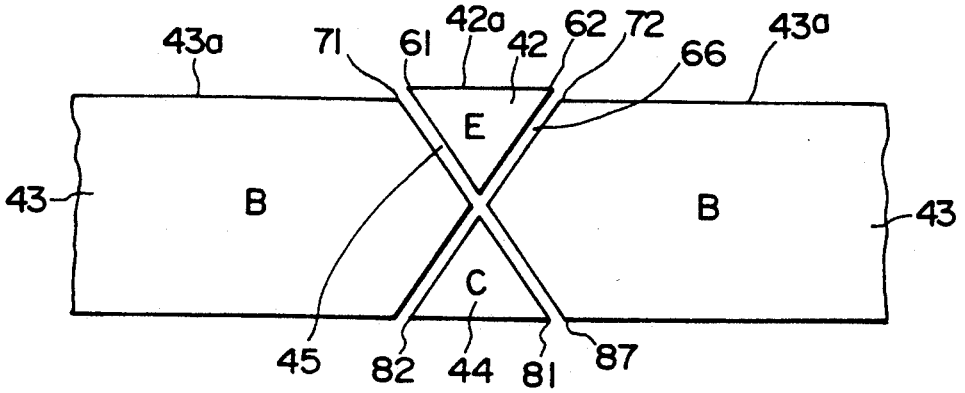
FIG. 20 is a sectional view taken along line XX—XX of FIG. 16.

Referring now to FIG. 20, there is shown a section of a portion corresponding to the rectangular portion 42*c* of the emitter electrode 42. Since the distance between the ends 61 and 62 in the section of FIG. 20 decreases relative to in the section of FIG. 19, the crossing point 47 between the grooves 45 and 46 is positioned at a central portion of the tungsten layer 41 in the thicknesswise dimension. As a result, the thickness of the emitter electrode 42 and the thickness of the collector electrode 44 in the Z direction in the section of FIG. 10 are substantially equal to each other.

Figure 21:
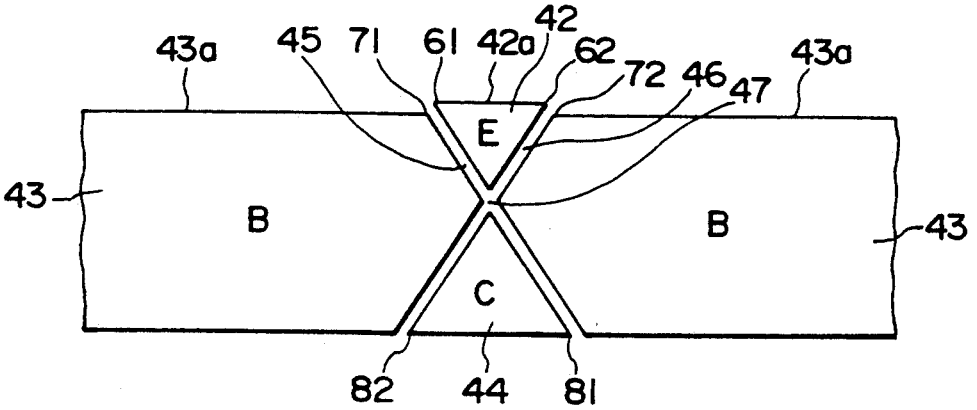
FIG. 21 is a sectional view taken along line XXI—XXI of FIG. 16.

FIG. 21 shows a section which includes the end portion 42*b* of the emitter electrode 42. The distance between the ends 61 and 62 is smaller than the width of the rectangular portion 42*c* of the emitter electrode 42 and the crossing point 47 of the grooves 45 and 46 has a higher position, and the sectional area of the collector electrode 44 relative to the entire sectional area of the transistor increases.

Figure 22:
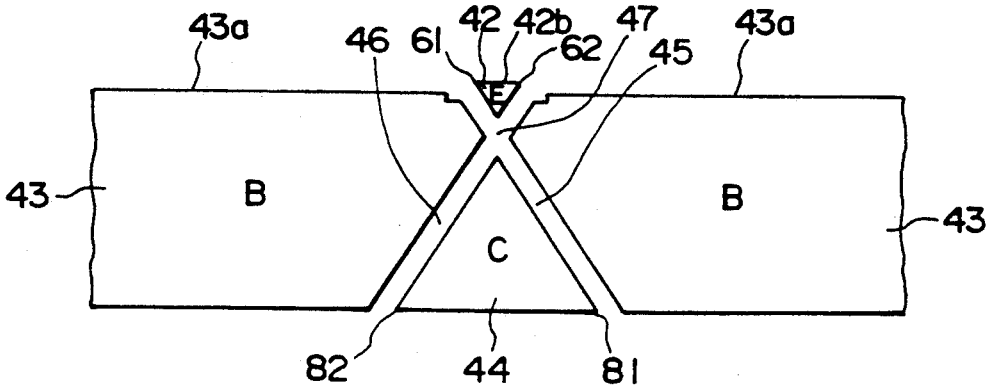
FIG. 22 is a sectional view taken along line XXII—XXII of FIG. 16.

Referring to FIG. 22, in a section shown, the steps defining the grooves 45 and 56 are such that the distances between the ends 61 and 62 of the emitter electrode 42 are less.

Since the step between the surface portion 42*a* of the emitter electrode 42 and the surface portion 44*a* of the collector electrode 44 is greater than the step between the emitter electrode 42 and the base electrodes 43, the grooves 45 and 46 have a greater width. In the present section, the end portion 42*b* of the emitter electrode 42 remains small, and the opposing collector electrodes 44 is located below the end portion 42*b* of the emitter electrode 42 with the crossing point 47 of the grooves 45 and 46 therebetween.

Figure 23:
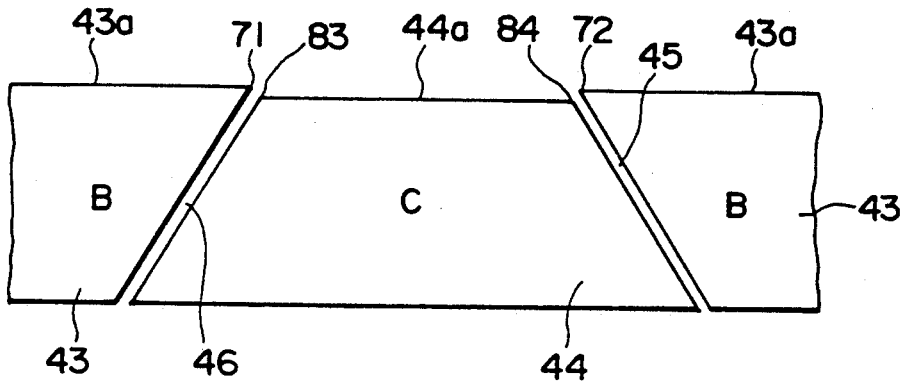
FIG. 23 is a sectional view taken along line XXIII—XXIII of FIG. 16.

FIG. 23 shows a section including the surface portion 44*a* of the collector electrode 44. Since ends 83 and 84 of the surface portion 44*a* of the collector electrode 44 are located lower than the ends 71 and 72 of the base electrodes 43, the steps are provided in an inwardly opposing relationship to each other and the grooves 45 and 46 which are formed from such steps and do not cross each other. In the present section, the collector electrode 44 has a trapezoidal shape with a longer bottom side.

FIG. 24 shows a section taken along the X axis. Accordingly, the base electrodes 43 do not appear in the present section. The crossing portion 47 of the grooves 45 and 46 extends continuously in the section and extends obliquely at the base end portion 42*d* and the other end portion 42*b* of the emitter electrode 42 and extends parallel to the main surface of the tungsten layer 41.

FIG. 25 shows another section taken along a plane parallel to the X axis and displaced from the plane of the section of FIG. 24 toward the −Y side. In the present section, the emitter electrode 42 is formed at the rectangular portion 42*c* with a small thickness on the surface of the transistor and the collector electrode 44 is formed with a small thickness on the bottom of the transistor while one of the electrodes 43 is located between the emitter electrode 42 and collector electrode 44. The groove 46 is between the base electrode 43 and emitter electrode 42 while the groove 45 is between the base electrode 43 and collector electrode 44. At a location of the rectangular portion 42*c* of the emitter electrode 42, the emitter electrode 42, collector electrode 44 and base electrodes 43 extend parallel to each other, but at locations of the base end portion 42*d* and the other end portion 42*b* of the emitter electrode 42, the grooves 45 and 46 extend obliquely with respect to the main surface of the tungsten layer 41.

The transistor having such structure as described above is encapsulated with a silicon oxide film or the like such that the spacings between the electrodes may be in vacuum. Thus, electrons are emitted from the emitter electrode 42 toward the collector electrode 44, and arrival of such electrons to the collector electrode 44 is controlled by the base electrodes 43. Since the distance between the emitter electrode 42 and collector electrode 44 is determined by at the crossing point 47 of the grooves 45 and 46 formed by oblique etching of the step, it is a very small distance such as is provided by an edge of a cutter. Consequently, a high speed operation and a high mutual conductance $g_m$ as well as a low potential difference operation of the transistor can be achieved and low power consumption can be realized.

Subsequently, a process of producing a transistor according to a fifth preferred embodiment of the present invention will be described with reference to FIGS. 26 to 34.

Figure 26:
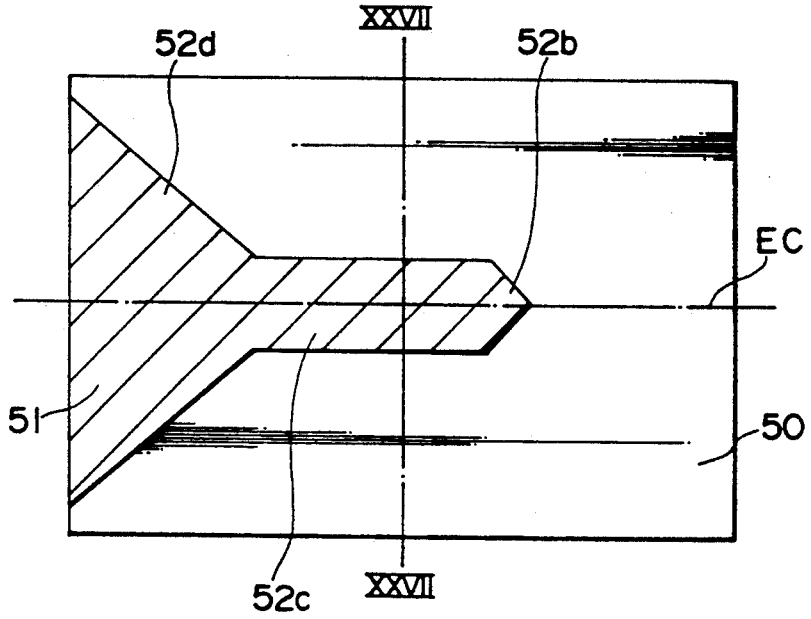
FIG. 26 is a schematic sectional view illustrating a step of formation of a resist layer on a tungsten substrate in a process of manufacturing the vacuum microelectronic transistor of FIG. 15.
Figure 27:
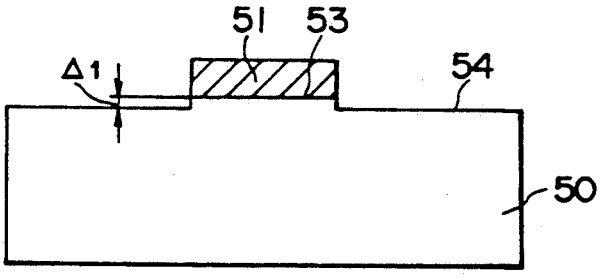
FIG. 27 is a sectional view taken along line XXVII—XXVII of FIG. 26.

First, a tungsten layer 50 is formed as an electrode material layer on an insulating film (not shown) formed on an insulating substrate (not shown) such as silicon dioxide or a semiconductor substrate. Then, a resist layer 51 is applied to the entire surface of the tungsten layer 50 and selectively exposed to light with a pattern as shown in FIG. 26 to develop an image. The pattern of FIG. 26 is a continuous combination of patterns of the trapezoidal base end portion 52*d*, rectangular portion 52*c* and triangular end portion 52*b* and coincides with a shape in plan of an emitter electrode to be obtained finally. The pattern is symmetrical with reference to a center line EC interconnecting an emitter electrode and a collector electrode to be formed. After formation of the resist layer 51 of such pattern, etching of the tungsten layer 50 is performed by an RIE method or the like using the resist layer 51 as a mask. The amount of such etching is, for example, several hundreds angstroms to several thousands angstroms or so. As a result of such etching, a step $\Delta_1$ is formed between a surface 53 of the tungsten layer 50 below the mask and a surface 54 formed by such etching. FIG. 27 is a sectional view taken along line XXVII—XXVII of FIG. 26 and shows a section including the rectangular portion 52*c*. The surface 53 below the resist layer 52 serving as a mask is located higher than the surface 54 formed by etching.

Figure 28:
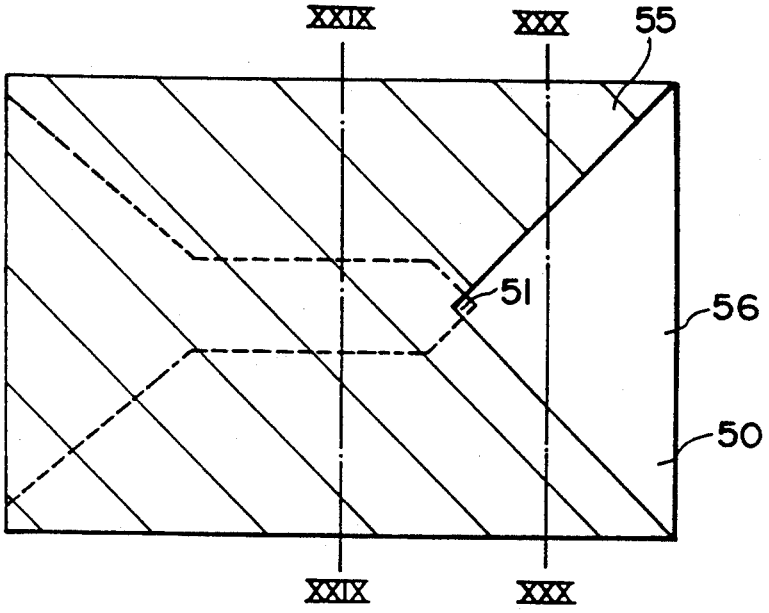
FIG. 28 is a schematic sectional view illustrating a next step of formation of another resist layer in the process of manufacturing the vacuum microelectronic transistor of FIG. 15.
Figure 29:
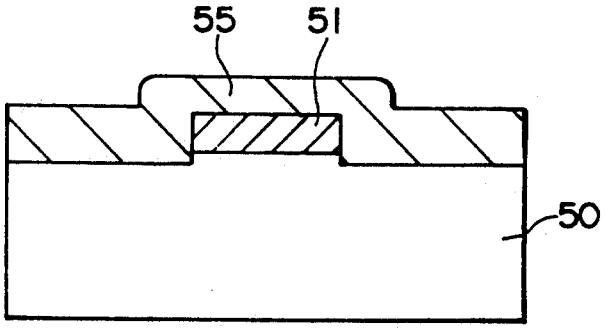
FIG. 29 is a sectional view taken along line XXIX—XXIX of FIG. 28.
Figure 30:
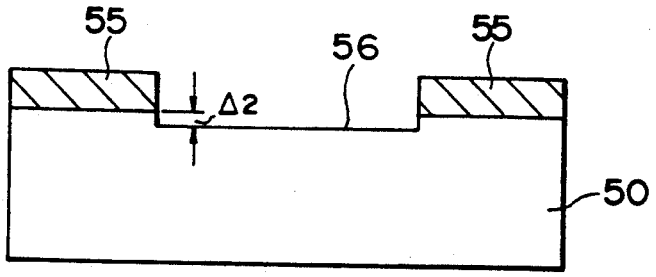
FIG. 30 is a sectional view taken along line XXX—XXX of FIG. 28.

Subsequently to such etching, another etching to form a collector electrode is performed. In order to obtain a pattern of such collector electrode, first a resist layer 55 is applied to the entire surfaces of the tungsten layer 50 and resist layer 51, and then the resist layer 55 is selectively exposed to light of a pattern which is open in a triangular shape at a portion on the collector side to develop an image. The resist layer 51 is not removed before the application of the resist layer 55, and consequently, the resist layer 55 is overlapped with all of the base end portion 52*d* and rectangular portion 52*c* and part of the end portion 52*b* of the resist layer 51. As a result, a location where the tungsten layer 50 is exposed is the location of the substantially triangular pattern 56 at which the resist layer 55 is not formed, but the resist layer 51 is partially exposed at a small amount at a location of an apex of the substantially triangular pattern 56 adjacent the emitter as shown in FIG. 28. FIG. 29 a sectional view taken along line XXIX—XXIX of FIG. 28, and as seen in FIG. 29, the resist layers 51 and 55 are layered in a region corresponding to the pattern of the rectangular portion 52C. The resist layer 55 also covers over the step $\Delta_1$ described above. After formation of such resist layer 55. etching of the tungsten layer 50 is performed in a direction perpendicular to the main surface of the tungsten layer 50 by an RIE method using the resist layers 55 and 51 as a mask. Consequently, the surface of the tungsten layer 50 is further removed at the location of the pattern 56 where the tungsten layer 50 is exposed so that another step $\Delta_2$ is formed as shown in FIG. 30 which is a sectional view taken along line XXX—XXX of FIG. 28. Thus, a total of two steps the steps $\Delta_1$ and $\Delta_2$ are formed.

Figure 31:
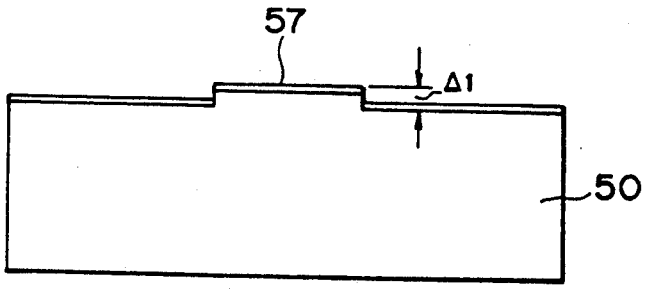
FIG. 31 is a schematic view showing the tungsten substrate after formation of an aluminum film after removal of the resist layers in the process of manufacturing the vacuum electronic transistor of FIG. 15.

After the formation of such two steps $\Delta_1$ and $\Delta_2$, the resist layers 51 and 55 are removed. Consequently, three faces including a face to make an emitter electrode, another face to make a base electrodes and a further face to make a collector electrode are exposed at the surface of the tungsten layer 50. Then, an aluminum film 57 is formed on the entire face of the block by vapor deposition or the like with a film thickness such that it is not applied to the stepped portions. The aluminum film 57 functions as a mask upon etching as it is vapor deposited in a direction perpendicular to the main surface of the tungsten layer 50. FIG. 31 shows a section after the aluminum film 57 is formed, and as a seen in FIG. 31, the step $\Delta_1$ ($\Delta_2$) is exposed for a short distance less than the thickness thereof by the thickness of the aluminum film 57.

Figure 32:
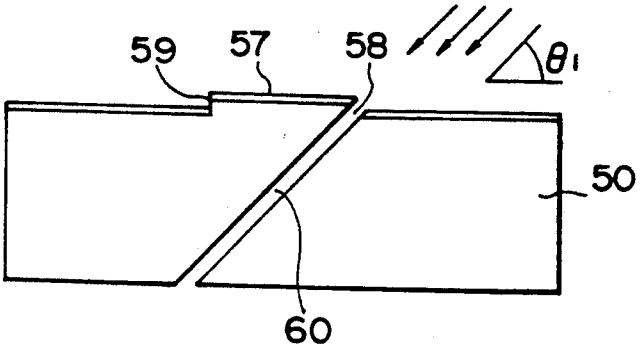
FIG. 32 is a schematic view illustrating first etching of the tungsten substrate shown in FIG. 31.

After the formation of the aluminum film 57 which acts as a mask upon etching, a first oblique etching is performed for the main surface of the tungsten layer 50 as seen from FIG. 32. The direction of such etching is such a direction that it has no component in an axis of coordinate taken along the aforementioned center line EC extending perpendicularly to the section of FIG. 32 from the emitter to the collector. The etching direction is inclined, for example, by an angle of $\theta_1$ in the section of FIG. 31 with respect to the main surface of the tungsten layer 50. Consequently, for example, on one side 58 of the step $\Delta_1$, a stepped portion of the tungsten layer 50 is opposed to the etching direction, but on the other side of the step $\Delta_1$, a stepped portion of the tungsten layer 50 is hidden by the aluminum film 57 against etching. As a result, a groove 60 oblique to the main surface of the tungsten layer 50 is formed only on the one side 58 of the step $\Delta_1$. The groove 60 extends to the bottom of the tungsten layer 50. The tungsten layer 50 is not etched at any portion other than the step thereof because it is covered with the aluminum layer 57.

Figure 33:
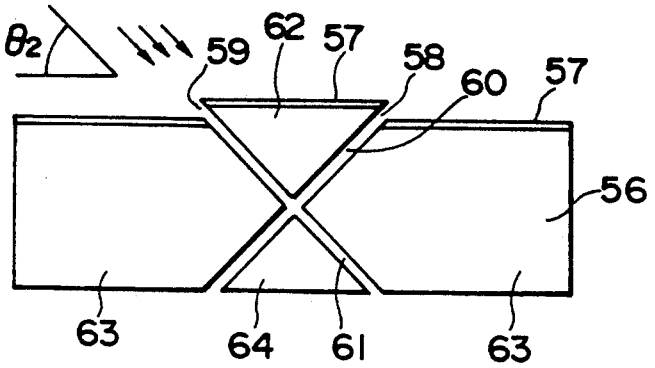
FIG. 33 is a schematic view illustrating second etching of the tungsten substrate shown in FIG. 32.

Subsequently, a second oblique etching is performed in an oblique direction at an angle of $\theta_2$ in a symmetrical relationship to the direction of the first oblique etching with respect to the center line EC for the main surface of the tungsten layer 50. The second oblique etching progresses from the other side 59 of the step $\Delta_1$ but does not progress from the first side 58. As a result of such second oblique etching, another groove 61 oblique to the main surface of the tungsten layer 50 is formed in the tungsten layer 50 as shown in FIG. 33. The tungsten layer 50 is not etched at any other portion than the step thereof since it is covered with the aluminum film 57. As a result of such two etching operations, the grooves 60 and 61 are formed in the tungsten layer 50 such that they cross each other to form an X-shaped section. The emitter electrode 62, base electrodes 63 and collector electrode 64 are thus separated from each other by the grooves 60 and 61 a very small distance reflecting the very small step, and the emitter electrode 62 and the collector electrode 64 are opposed to each other at a location where the two grooves 60 and 61 cross each other.

Figure 34:
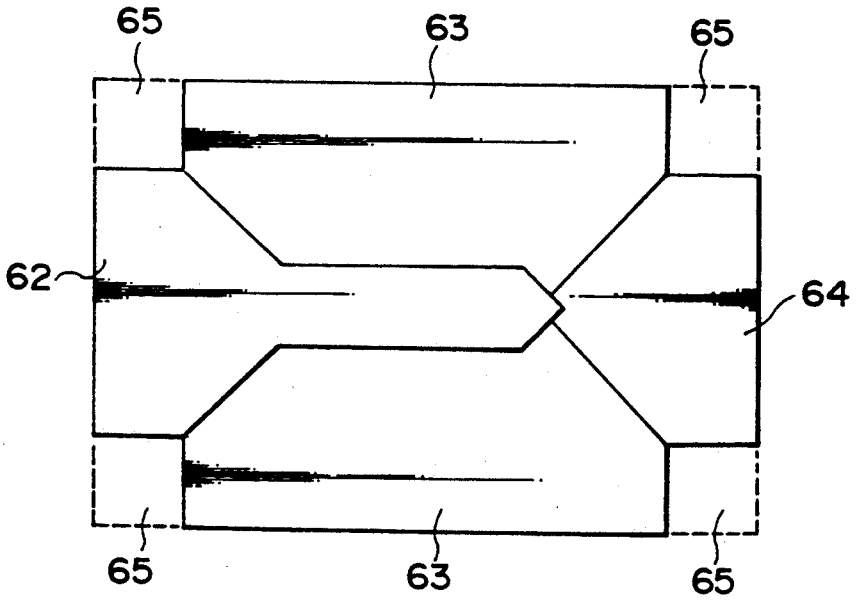
FIG. 34 is a schematic top plan view illustrating etching of four corners of the tungsten substrate shown in FIG. 33.

After the separation of the emitter electrode 62, base electrodes 63 and collector electrode 64 from one another by the two etching operations in the two oblique directions, corner portions 65 remote from the opposing portions of the electrodes are removed by etching in a direction perpendicular to the main surface of the tungsten layer 50 as seen from FIG. 34. Then, formation of an insulating film or the like for encapsulating the block to keep the grooves 60 and 62 in vacuum over the entire face of the block, leading out of the electrodes and so forth are performed to complete the transistor element.

Since such manufacturing process as described above is employed, the emitter electrode 62, base electrodes 63 and collector electrode 64 can be formed at a very short distance from one another on the tungsten layer 50, and a device thus obtained has such very high performances as described hereinabove. Particularly, since a combination of a step and oblique etching is employed in the present embodiment, a very short distance can be assured from one another even where the accuracy of a resist mask is not sufficiently high. Oblique etching may be performed twice in two different directions, and the aluminum film 57 can be used commonly for the two oblique etching operations, which facilitates the oblique etching.

It is to be noted that, while tungsten is employed for an electrode material layer in the embodiment described above, it is also possible to employ a metal having a high melting point such as molybdenum or some other metal for the electrode material layer.

A device manufactured in accordance with the process of the embodiment described above may be modified such that a portion thereof which obtains the nonlinearity of a transistor is formed from polycrystal. Consequently, such three-dimensional structure as illustrated in FIG. 35 can be achieved.

Figure 35:
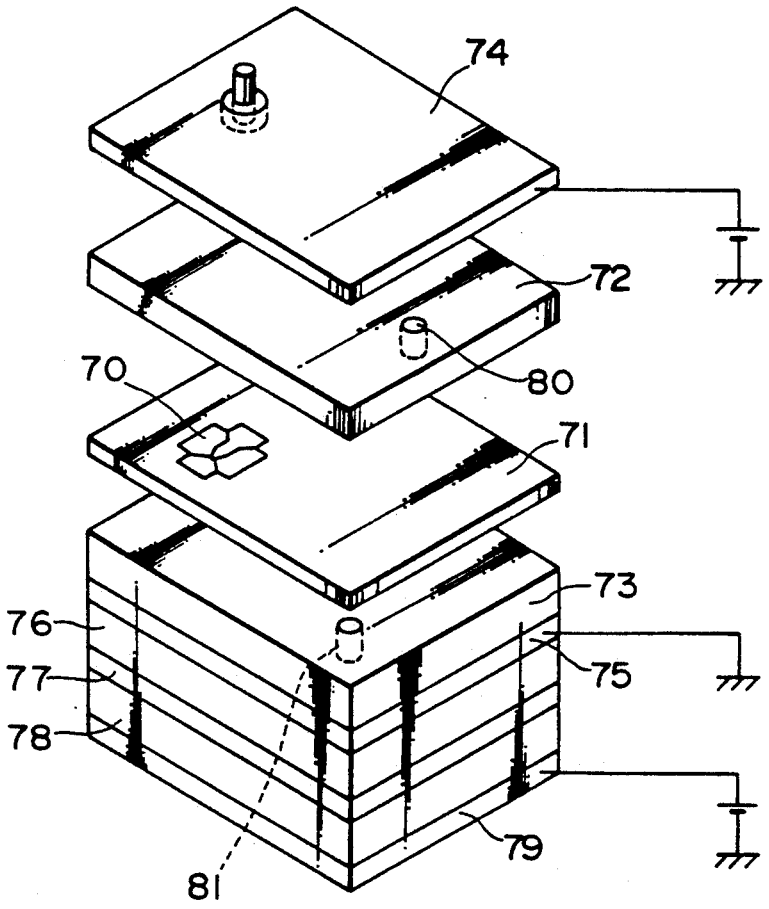
FIG. 35 is a schematic fragmentary perspective view of an arrangement wherein such vacuum microelectronic transistors as shown in FIG. 15 are combined in a three-dimensional structure.

Referring to FIG. 35, such a transistor device 70 as described above is formed on a tungsten layer 71. A plurality of such transistor devices 70 can be formed on the tungsten layer 71. The tungsten layer 71 is held between a pair of insulating films 72 and 73 so that spacings between electrodes of the transistor elements 70 are encapsulated in vacuum. A power supply voltage Vcc is supplied to a conductive layer 74 which is stacked on the insulating film 72. The power supply voltage Vcc is supplied to the transistor devices 70 by way of a conductive portion 80 formed on the insulating film 72. The ground voltage is supplied to a conductive layer 75 so that it may be supplied to the transistor devices 70 by way of a conductive portion 81 formed on the insulating film 73. While the conductive layer 74, insulating film 72, tungsten layer 71, insulating film 73 and conductive layer 75 are layered in this order from above, the conductive layer 75, a further insulating film 76, another tungsten layer 77, a still further insulating film 78 and a still further conductive layer 79 may be arranged in a similar layered relationship and films may additionally be formed in a similar layered relationship to obtain devices of a required three-dimensional structure.

Where such structure is employed, radiation of heat with a high efficiency is achieved by a conductive layer which is superior in heat conduction, and due to the structure of the device which is held between conductive layers, shielding from electromagnetic waves can be achieved. It is to be noted that resistors, capacitors and other elements can be formed together with transistors on a tungsten layer.

Having now fully described the invention, it will be apparent to one of ordinary skill in the art that many changes and modifications can be made thereto without departing from the spirit and scope of the invention as set forth herein.

What is claimed is:

1. A vacuum microelectronic transistor, comprising a substrate, an emitter formed on said substrate for emitting electrons therefrom, a collector formed on said substrate in an opposing spaced relationship from said emitter for receiving electrons from said emitter, and a gate electrode formed on said substrate in a spaced relationship from said emitter and collector for controlling arrival of electrons from said emitter to said collector, said emitter having a linear end extending at an angle greater than 0 degrees but smaller than 90 degrees with respect to a normal line to a plane of said substrate, and wherein said collector has a linear end extending at an angle to the angle of said linear end of said emitter with respect to the normal line to the plane of said substrate.

2. A vacuum microelectronic transistor according to claim 1, wherein said emitter has a prism-like projected portion having said linear end opposed to said collector.

3. A vacuum microelectronic transistor according to claim 1, wherein said collector has a prism-like projected portion having said linear end opposed to said emitter.

4. A vacuum microelectronic transistor according to claim 1, further comprising another gate electrode, the two gate electrodes being disposed adjacent and across a path of electrons from said emitter to said collector.

5. A vacuum microelectronic transistor, comprising a substrate, an emitter formed on said substrate for emitting electrons therefrom, a collector formed on said substrate in an opposing spaced relationship from said emitter for receiving electrons from said emitter, and a gate electrode formed on said substrate in a spaced relationship from said emitter and collector for controlling arrival of electrons from said emitter to said collector, said emitter having an end at which a plurality of three-dimensionally pointed projected portions are provided, said collector having a linear end, said gate electrode being formed adjacent a straight line interconnecting said emitter and collector.

6. A vacuum microelectronic transistor according to claim 5, further comprising another gate electrode, the two gate electrodes being disposed adjacent and across a path of electrons from said emitter to said collector, said emitter, collector and gate electrodes being separated by a groove having an X-shape in a section taken perpendicularly to the path of electrons.

7. A semiconductor device comprising:

an emitter for emitting electrons therefrom;

an anode spaced from said emitter for receiving electrons emitted from said emitter; and a gate electrode for controlling arrival of electrons emitted from said emitter at said anode;

said emitter and anode being formed as a pair of mutually opposing projected portions of a semiconductor;

said gate electrode being formed adjacent a straight line interconnecting said emitter and anode, further comprising another gate electrode, the two gate electrodes being disposed adjacent and on opposite sides of a path of electrons from said emitter to said collector, and wherein each of said emitter and collector has a linear end extending perpendicularly to a path of electrons from said emitter to said anode and said linear ends of said emitter and collector extend at an angle greater than zero degrees but smaller than 90 degrees with respect to a line between said gate and said another gate electrodes.

8. A vacuum microelectronic transistor, comprising a substrate, and emitter formed on said substrate, a collector formed on said substrate in an opposing spaced relationship from said emitter, a first gate electrode formed on said substrate in a spaced relationship from said emitter and collector and an X shaped groove between said emitter, said collector and said first gate electrode, wherein said emitter and said collector have linear ends.

9. A vacuum microelectronic transistor, according to claim 8, further comprising a second gate electrode, said first and second gate electrodes being disposed adjacent and on opposite sides of the path of electrons from said emitter to said collector.

10. A semiconductor device, comprising:

an emitter;

a collector spaced from said emitter;

and a first gate electrode;

wherein said emitter and said collector are formed as a pair of mutually opposing projected portions of a semiconductor, said first gate electrode formed adjacent a straight line interconnecting said emitter and said collector, and a groove formed between said emitter, said collector and said first gate electrode being cross-sectionally X-shaped.

11. A semiconductor device according to claim 10 further comprising a second gate electrode, said first and second gate electrodes being disposed adjacent and on opposite sides of the path of electrons from said emitter to said collector.

12. A semiconductor device, comprising:

an emitter;

a collector spaced from said emitter;

and a gate electrode;

wherein said emitter and said collector being formed as a pair of mutually opposing projected portions of a semiconductor, said gate electrode being formed adjacent a straight line interconnecting said emitter and said collector, and said emitter having a linear end.

13. A semiconductor device according to claim 12 comprising an X-shaped groove formed between said emitter and said collector and said gate electrode.

* * * * *